US007062949B1

(12) United States Patent
Haulsee

(10) Patent No.: US 7,062,949 B1
(45) Date of Patent: Jun. 20, 2006

(54) METAL FORMING PRESS HAVING STRAIGHT LINE DRIVE MECHANISM

(76) Inventor: Donald R. Haulsee, 135 Eagle Bluff Dr., Claremont, VA (US) 23899

( * ) Notice: Subject to any disclaimer, the term of this patent is extended or adjusted under 35 U.S.C. 154(b) by 361 days.

(21) Appl. No.: 10/742,428

(22) Filed: Dec. 19, 2003

Related U.S. Application Data

(60) Provisional application No. 60/434,541, filed on Dec. 20, 2002.

(51) Int. Cl.
*B30B 5/00* (2006.01)
*B21J 9/18* (2006.01)

(52) U.S. Cl. ..... 72/450; 72/347; 72/349; 72/451; 72/456; 100/282

(58) Field of Classification Search ..... 72/347, 72/349, 450, 451, 456; 100/282, 285, 214
See application file for complete search history.

(56) References Cited

U.S. PATENT DOCUMENTS

| | | | | | |
|---|---|---|---|---|---|
| 3,766,771 | A | * | 10/1973 | Spachner et al. | 100/282 |
| 3,817,139 | A | * | 6/1974 | Desai et al. | 100/282 |
| 4,107,973 | A | * | 8/1978 | Smejkal et al. | 72/450 |
| 4,578,981 | A | * | 4/1986 | Nishikawa et al. | 72/347 |
| 4,996,865 | A | * | 3/1991 | Haulsee et al. | 72/349 |
| 5,335,532 | A | * | 8/1994 | Mueller et al. | 72/450 |
| 5,546,785 | A | * | 8/1996 | Platt et al. | 100/282 |
| 6,012,322 | A | * | 1/2000 | Itakura | 72/450 |

* cited by examiner

*Primary Examiner*—David Jones

(57) ABSTRACT

A metal forming press has an oscillating beam driven at its center by a connecting rod connected to a throw on a crankshaft. The upper end of the beam is pivoted to a link which drives a ram. The lower end of the beam pivots about a rotating eccentric shaft having an eccentric lobe. As the beam oscillates, these eccentricities cause the lower pivot to move toward and away from the ram so that the arc of the upper pivot approximates a straight line.

9 Claims, 28 Drawing Sheets

1
2
33
3

34
1
5

35

28
23

Link Angle Versus Crank Degreees

Vertical Ram Forces Vs Degrees

METAL FORMING PRESS HAVING STRAIGHT LINE DRIVE MECHANISM

RELATED APPLICATION

This application discloses and claims subject matter which was disclosed in copending provisional patent application Ser. No. 60/434,541, filed Dec. 20, 2002 and titled "Metal Forming Press Having Straight Line Drive Mechanism".

BACKGROUND OF INVENTION

A typical metal forming power press is disclosed in Haulsee et al. U.S. Pat. No. 4,996,865.

Metal forming power presses generally use a crankshaft, a connecting rod, an oscillating or "swing" beam, and a link to force a forming punch mounted on a ram constrained by sliding element bearings through a series of dies to form a finished product. Such a prior art metal forming press is shown in FIG. 1.

Where the shape is intricate and a large amount of metal forming is required, a progressive tooling arrangement is used to form the product. Progressive tooling formation requires that the forming punch travel through the tools in a straight line to avoid damage to the tools and to create accurate finished products. A simple slider crank arrangement creates large forces normal to the motion of the punch-carrying ram causing distortions to ram movement.

A typical prior art metal forming press uses a five bar linkage to create ram movement. An eccentric throw on a crankshaft drives a connecting rod. The connecting rod is connected approximately halfway up an oscillating beam. The upper end of the oscillating beam is attached to one end of a short link, while the other end of the link is attached to a straight line guided ram.

One method used to lessen the magnitude of the normal forces is to add additional links to the slider crank arrangement to ensure that the link attached to the sliding ram has as little angular movement as possible while driving the ram. FIG. 2 shows such an arrangement commonly used in a can forming machine positioned at back dead center.

FIG. 3 shows this arrangement at back dead center in a side view.

In this arrangement, crankshaft 7 with eccentric throw 30 rotates clockwise. Eccentric throw 30 is attached by rotating joint 31 to connecting rod 6. Connecting rod 6 is connected to the approximate center of beam 5. Beam 5 is connected via lower pivot 35 to a pivot point, stationary shaft 32, in machine frame 10. As the crankshaft 7 rotates, connecting rod 6 is driven by eccentric throw 30 and thus forces beam 5 to oscillate through a given angle. Generally, the length of oscillating beam 5 is chosen so that the arc of movement of upper connection point 33 of beam 5 passes both above and below the centerline of ram 2 by an equal distance. The upper connection point 33 is connected to link 3. Link 3 is then connected via pivot pin 34 to ram 2.

As the crankshaft 7 and connecting rod 6 drive beam 5 through its oscillating motion, link 3 drives ram 2 horizontally through front and rear sliding bearings 1. Link 3, therefore, both translates and oscillates as it moves. The oscillation is troublesome in that, due to axial forming forces, forces normal to ram 2 are created by link 3 angularity. These normal forces then cause deflection of ram 2, which in turn causes poor tool life and finished product wall thickness variation.

FIG. 4 through FIG. 11 illustrate the angularity of link 3 during the movement of ram 2.

FIG. 4 shows that at back dead center for this common arrangement link 3 must be at a 2.5 degree down angle in order to connect ram 2 with beam 5.

FIG. 5 shows the lower pivot 35 of beam 5 constrained to rotate about stationary pivot point 32 in machine frame 10.

FIG. 6 shows this same linkage arrangement with ram 2 at mid stroke on the forward stroke. Beam 5 is now positioned vertically, and upper connection point 33 is now above the horizontally sliding line of motion of ram 2.

FIG. 7 is an enlarged detail view of link 3 connecting ram 2 and beam 5. Link 3 is now at a 2.5 degree up angle in order to connect ram 2 and beam 5.

FIG. 8 shows the lower pivot 35 of beam 5 constrained to rotate about stationary pivot point 32 in the machine frame 10.

FIG. 9 shows this same linkage arrangement with ram 2 at front dead center. Beam 5 is now positioned at an angle, and upper connection point 33 is now below the horizontally sliding line of motion of ram 2.

FIG. 10 is an enlarged detail view of link 3, which connects ram 2 and beam 5. Link 3 is now at a 2.5 degree down angle in order to connect ram 2 and beam 5.

FIG. 11 shows the lower pivot 35 of beam 5 constrained to rotate about stationary pivot point 32 in the machine frame 10.

Link 3 therefore has to operate at a changing angle so as to maintain the connection between upper connection point 33 of ram 2 which is constrained by front and rear sliding bearings 1 to move in a straight line.

The pivot at the upper end of the oscillating beam traces a partial arc through space. The ram is typically positioned so that this arc falls an equal amount to either side of ram centerline.

Inertial forces from accelerating and decelerating ram 2, as well as tool forming forces, are applied to pivot pin 34 by link 3. During the machine stroke, axial forces are carried by ram 2 through pivot pin 34 and thus into link 3. Since link 3 oscillates through an angle, normal forces are created equal to the tangent of the angle multiplied by the axial force component.

These normal forces seek to bend the ram and thus create distortions to the straight line movement of the ram.

Conventional metal forming presses seek to reduce ram distortion in one of four ways:

1. Rams of large cross section with high moments of inertia are used to resist the distortion. Reynolds Metals Company Mark III presses use a 5 inch diameter tubular ram to resist the high normal forces.
2. Way systems consisting of hardened flat steel surfaces are placed all around the moving ram. The way system has either rolling element bearings or hydrostatic bearings with small clearance to the ram. The way system then supports the ram and minimizes ram distortion from the normal forces. Standun and Carnot Metal Box metal forming presses use a way system.
3. A Watts linkage can be used to generate a better approximate straight line. Early Ragsdale metal forming presses use a Watts link.
4. A Peaucellier mechanism can be used to generate an exact straight line path. Current Ragsdale metal forming presses as manufactured by Alcoa Packaging Machinery use a "Diamond" mechanism which is a class of the Peaucellier mechanism.

Each of these approaches has problems.

A large cross section ram adds appreciable mass thus causing increased parts breakage, increased axial forces, and increased normal forces.

Way systems require the ram to be manufactured with a relatively large square or rectangular feature. This feature must be manufactured flat and perpendicular so as to be capable of being guided in straight line. The feature also adds significant mass to the ram system. This square or rectangular feature is then guided by the ways. The ways are subject to high wear and tightly controlled tolerances. Wear in the way system occurs when a rolling element bearing fails or a control orifice in one of the hydrostatic bearings plugs. When a support bearing fails, the ram contacts the way system, damaging the surfaces and necessitating press overhaul and parts replacement. Highly precise flatness and parallelism are required for the way system. Therefore, highly trained personnel and highly accurate measuring equipment are required to maintain the way system.

A Watts link is an approximate straight line solution and adds duplication of the oscillating beam on the opposite side of the mechanism. Reciprocating mass is essentially doubled, increasing parts breakage and axial forces. Details of a Watts link are discussed in engineering kinematic textbooks.

The Peaucellier mechanism generates a true straight line but more than doubles the number of links, and the additional links add reciprocating mass to the mechanism. The large number of links coupled with space considerations means that the mechanism is fragile. In order to maintain a straight line path, the pin joints of the linkage must have very little clearance. Wear in the pin joints destroys accuracy and allows impact forces to destroy the links. Details of a Peaucellier mechanism are discussed in engineering kinematic textbooks.

BRIEF SUMMARY OF THE INVENTION

The present invention is a method of eliminating normal forces to the motion of the ram without adding either a way system or additional links.

The invention consists of altering the method in which the lower pivot of the oscillating beam operates so that the pivot at upper end of the beam and thus the link move in a straight line.

The invention replaces the fixed lower beam pivot with a rotating eccentric shaft having an eccentric lobe. The amount of eccentricity of the eccentric lobe is the amount the beam swings above or below ram centerline.

When the mechanism is at either back dead center or front dead center the oscillating beam is at its maximum angle. The upper end of the oscillating beam in a conventional mechanism is below the ram centerline by some amount. The eccentric offset of the eccentric lobe in the eccentric shaft matches this distance. The eccentric shaft is rotated so that the eccentric lobe is positioned to raise the oscillating beam. This places the upper end on the ram centerline and therefore the link moves axially with the ram in a straight line.

When the mechanism is at mid-stroke the oscillating beam is vertical. The upper end of the oscillating beam in a conventional mechanism is above the ram centerline by some amount. The eccentric offset of the eccentric lobe in the eccentric shaft matches this distance. The eccentric shaft is rotated so that the eccentric lobe is positioned to lower the oscillating beam. This places the upper end on the ram centerline, and therefore the link moves axially with the ram in a straight line.

For exact straight line generation, the eccentric shaft must be driven in timed relationship with the crankshaft so that the sine of the angle of the eccentric shaft multiplied by the amount of eccentricity equals the uncorrected straight line error of upper pivot 32. Such corrections are best done by a programmable servo drive system.

For approximate straight line generation sufficient for most operational mechanisms, the eccentric shaft can be driven in a timed relationship with the crankshaft so that for every one degree of crankshaft rotation the eccentric shaft rotates 2 degrees.

The invention provides straight line correction without adding reciprocating mass to the ram system. Retrofitting an existing press to the invention allows ram mass to be decreased, thus allowing for higher machine speed and greater accuracy.

DETAILED DESCRIPTION OF INVENTION

Straight-Line Drive

Figure 1:
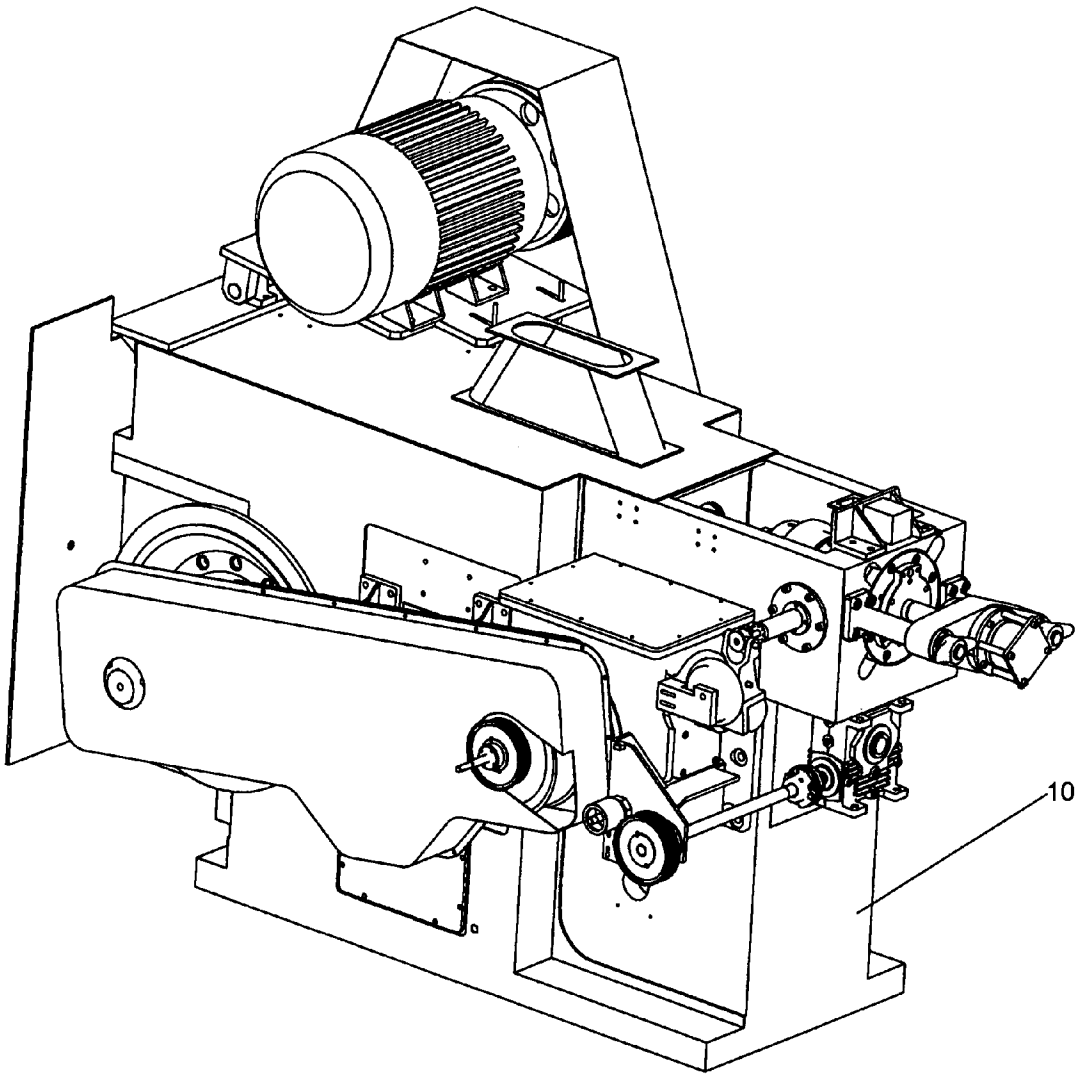
Figure 1 Prior Art
FIG. 1 is an isometric view of a typical prior art beverage can manufacturing press.
Figure 2:
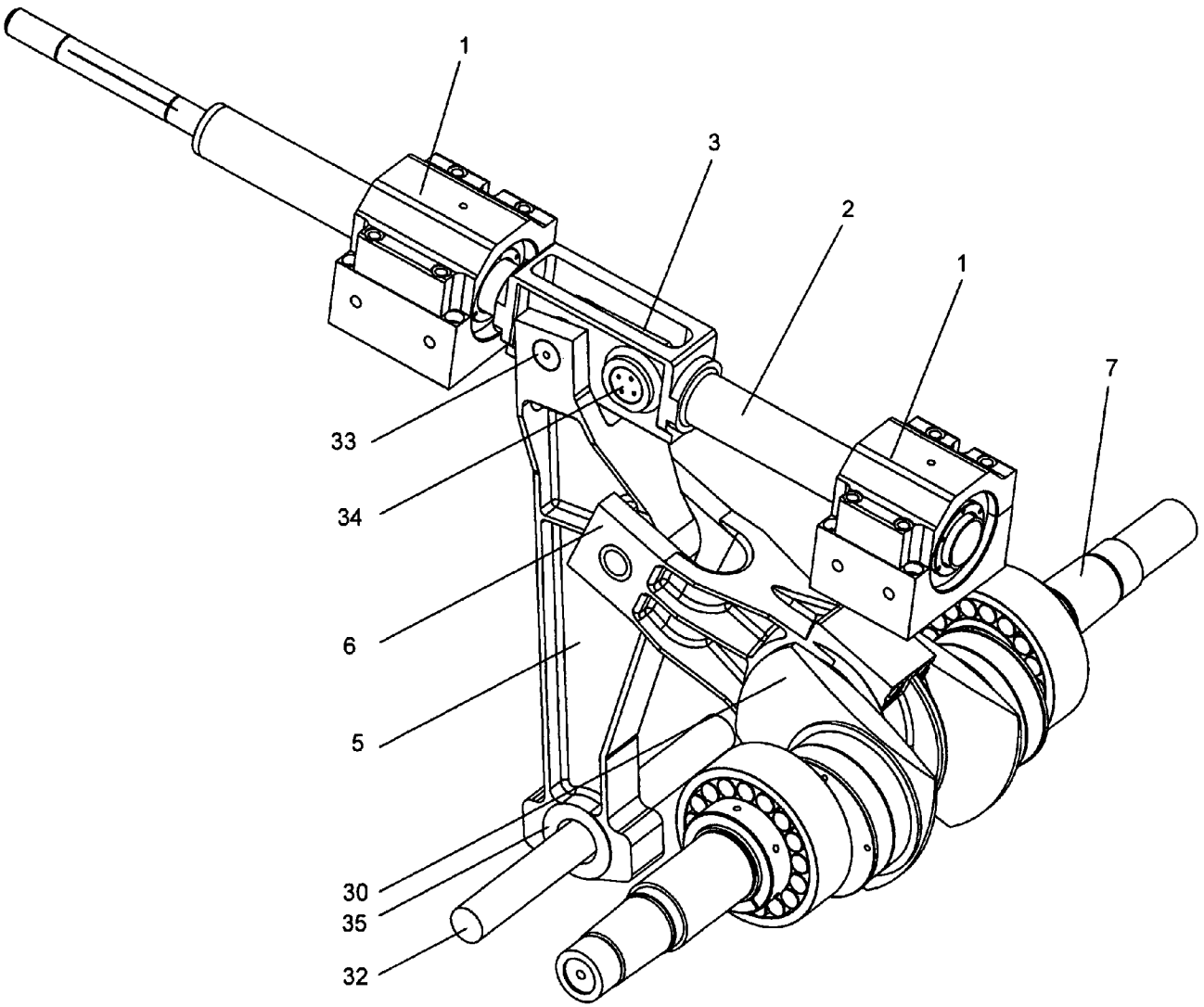
Figure 2 Prior Art
FIG. 2 is an isometric view of the internal components of a typical prior art beverage can manufacturing press.
Figure 3:
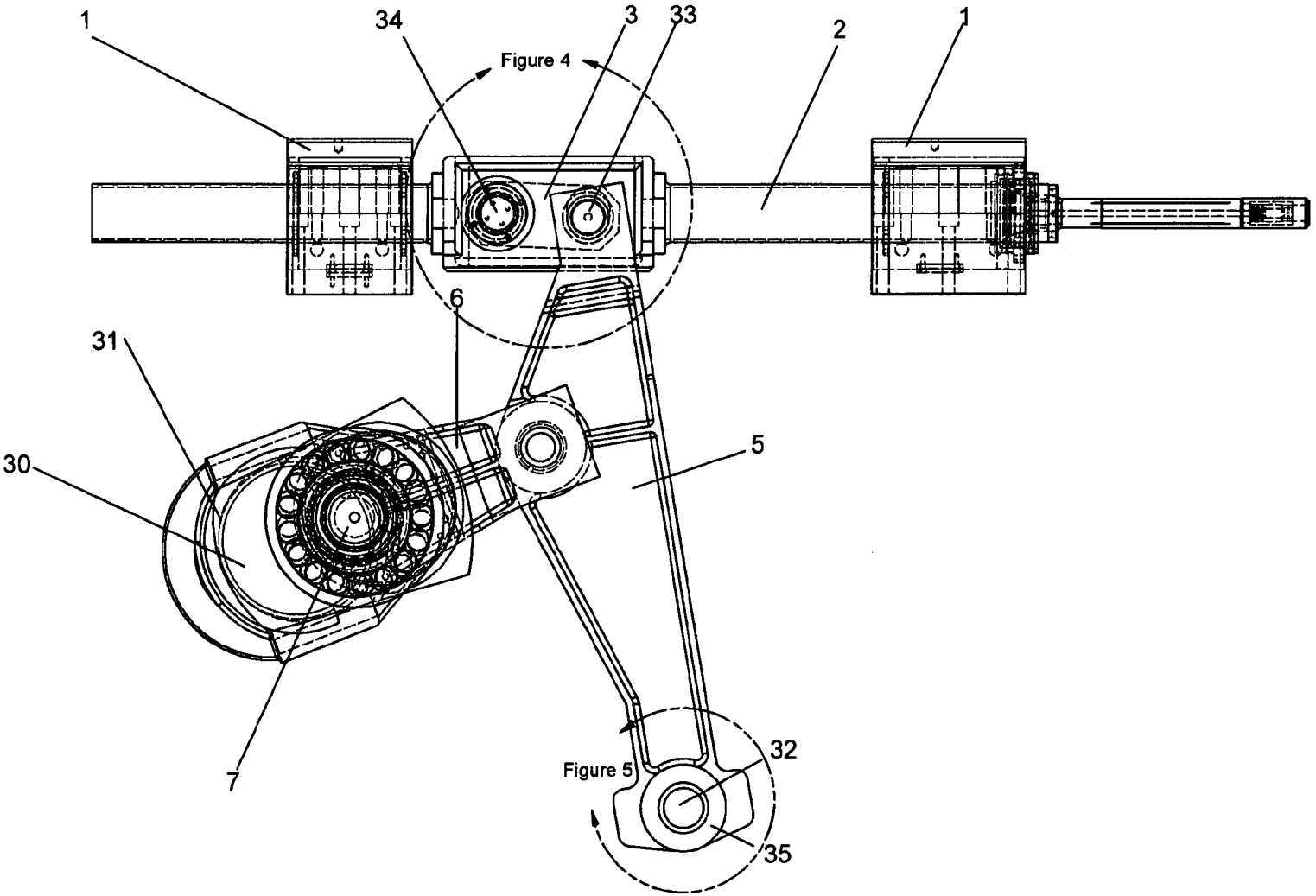
Figure 3 Prior Art
FIG. 3 is longitudinal cross section of FIG. 1 through ram centerline of the internal components with the press at back dead center.
Figure 4:
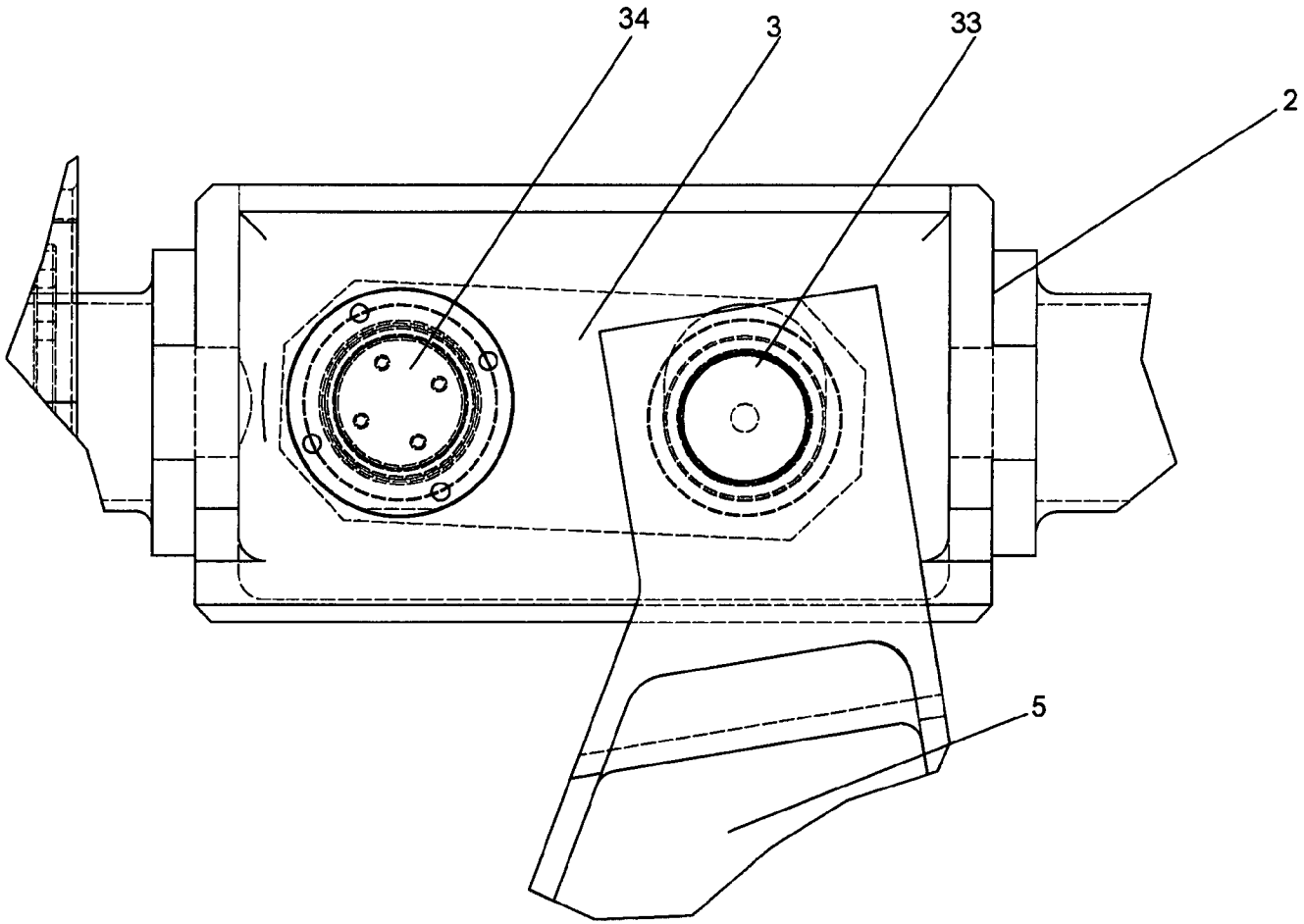
Figure 4 Prior Art
FIG. 4 is a large-scale detail view of FIG. 3 showing the ram driving connection point at back dead center
Figure 5:
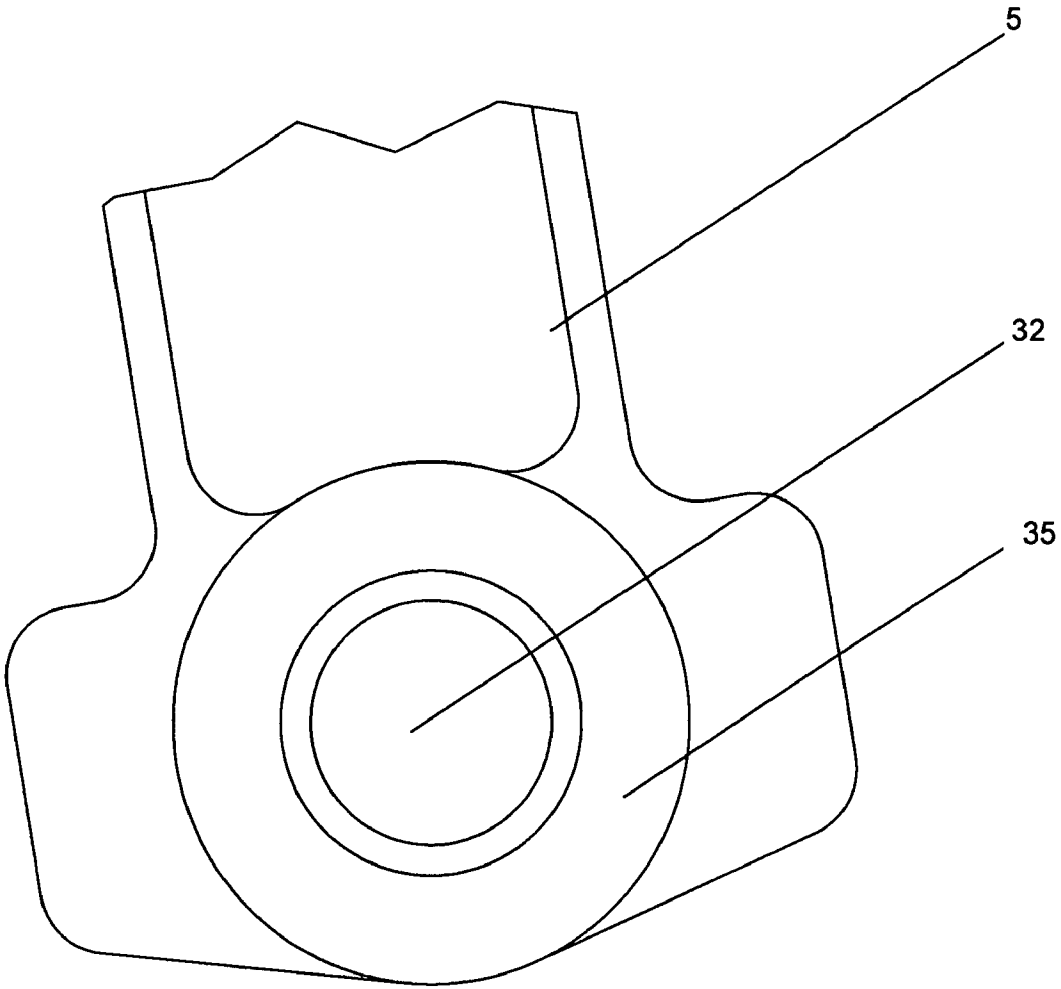
Figure 5 Prior Art
FIG. 5 is a large-scale detail view of FIG. 3 showing the beam pivot connection at back dead center.
Figure 6:
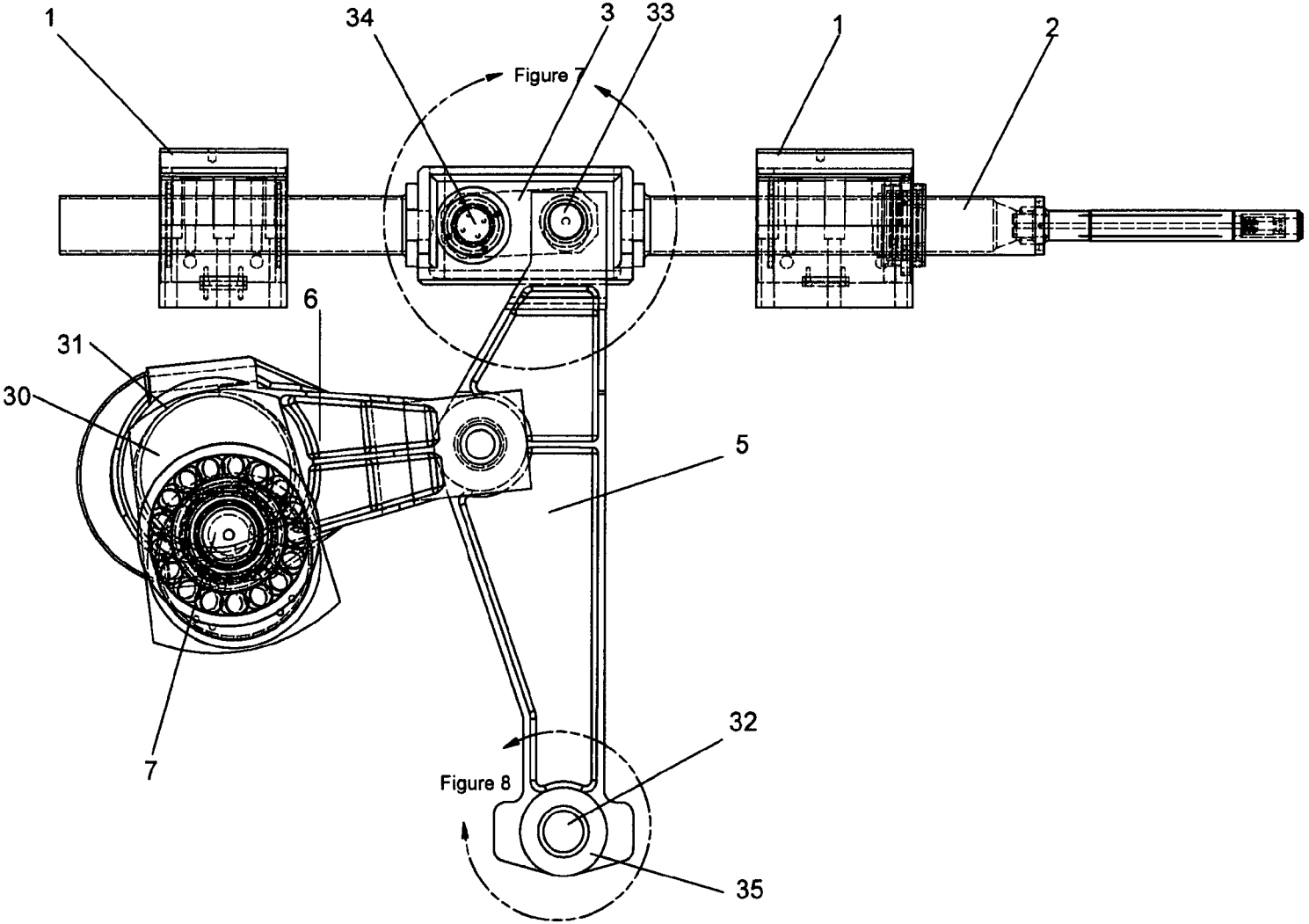
Figure 6 Prior Art
FIG. 6 is longitudinal cross section of FIG. 1 through ram centerline of the internal components with the press at mid stroke.
Figure 7:
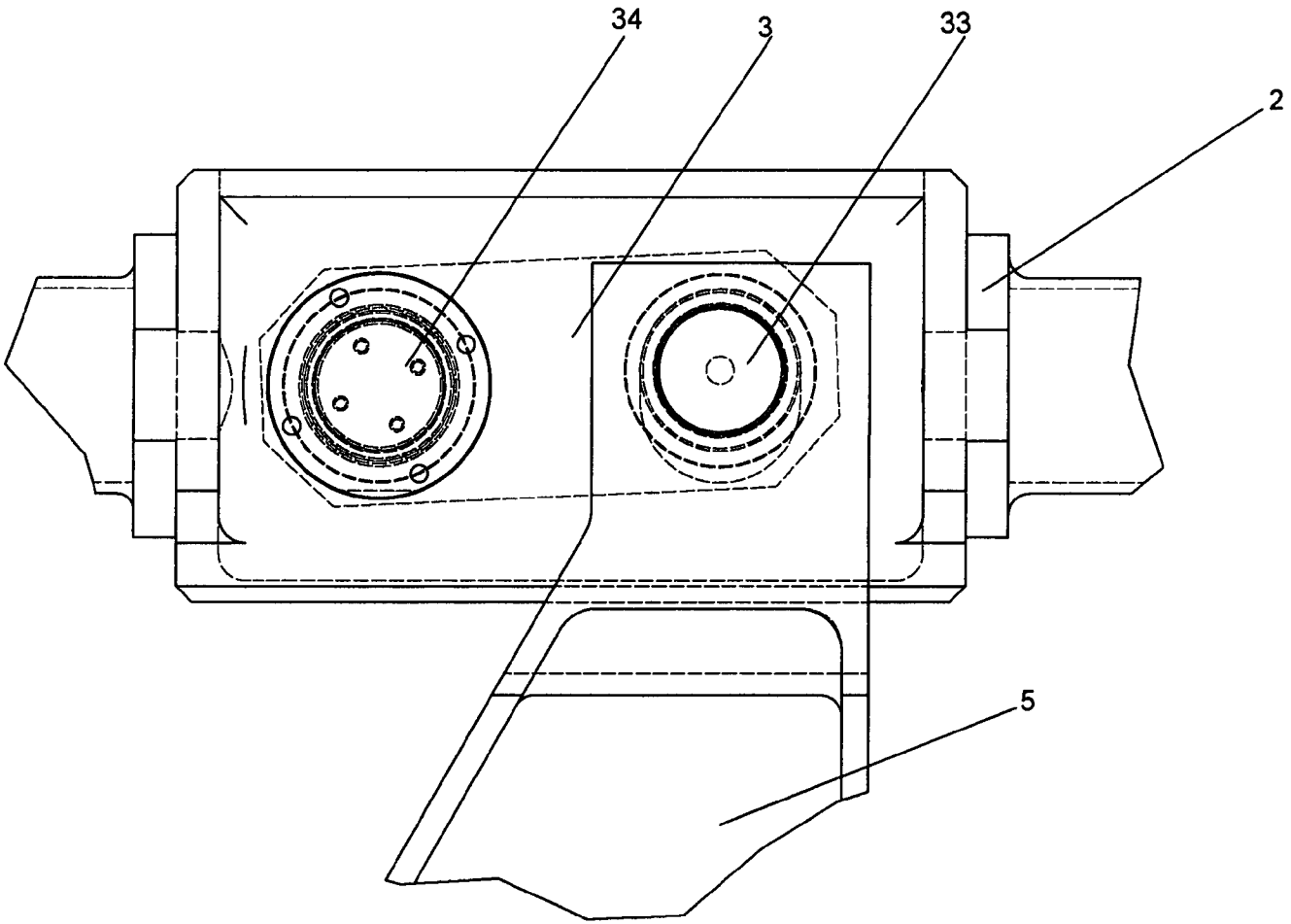
Figure 7 Prior Art
FIG. 7 is a large-scale detail view of FIG. 6 showing the ram driving connection point at mid stroke.
Figure 8:
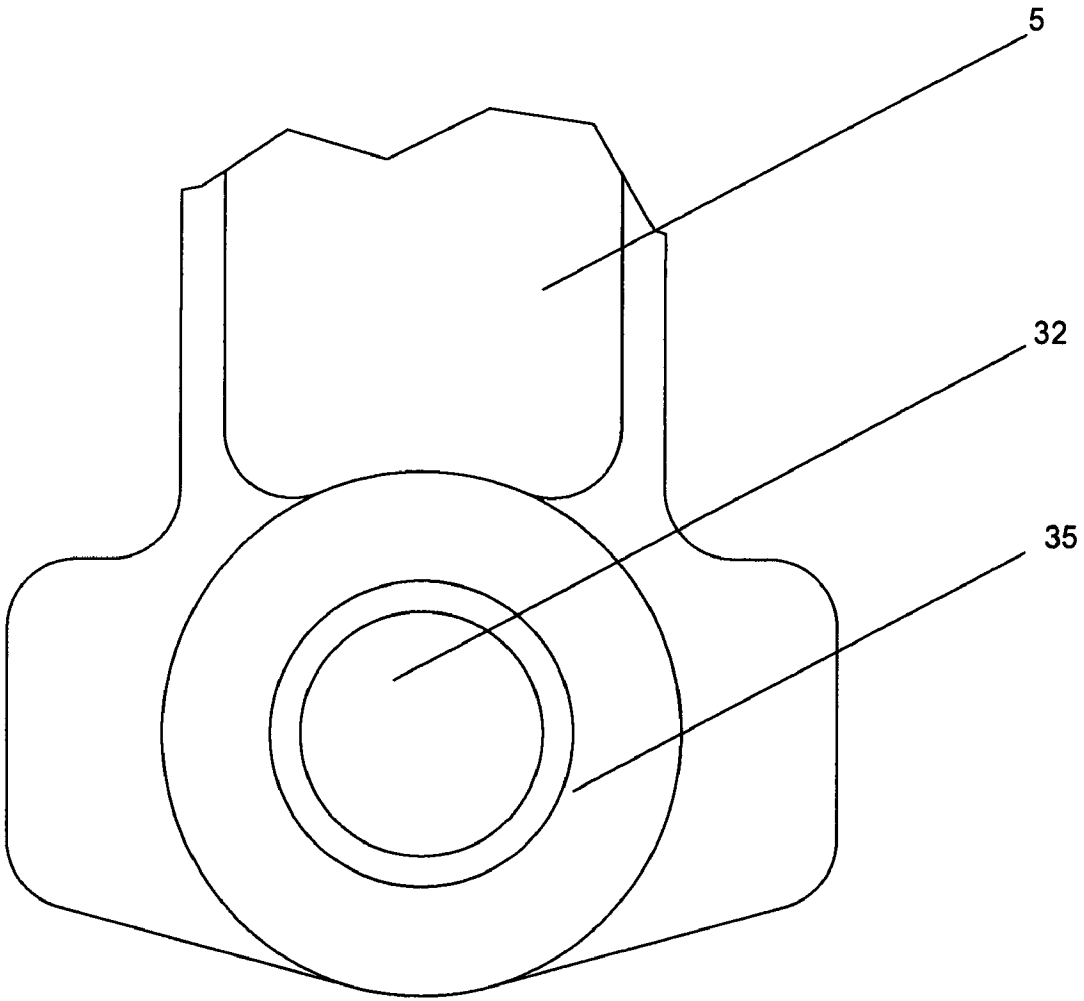
Figure 8 Prior Art
FIG. 8 is a large-scale detail view of FIG. 6 showing the beam pivot connection at mid stroke.
Figure 9:
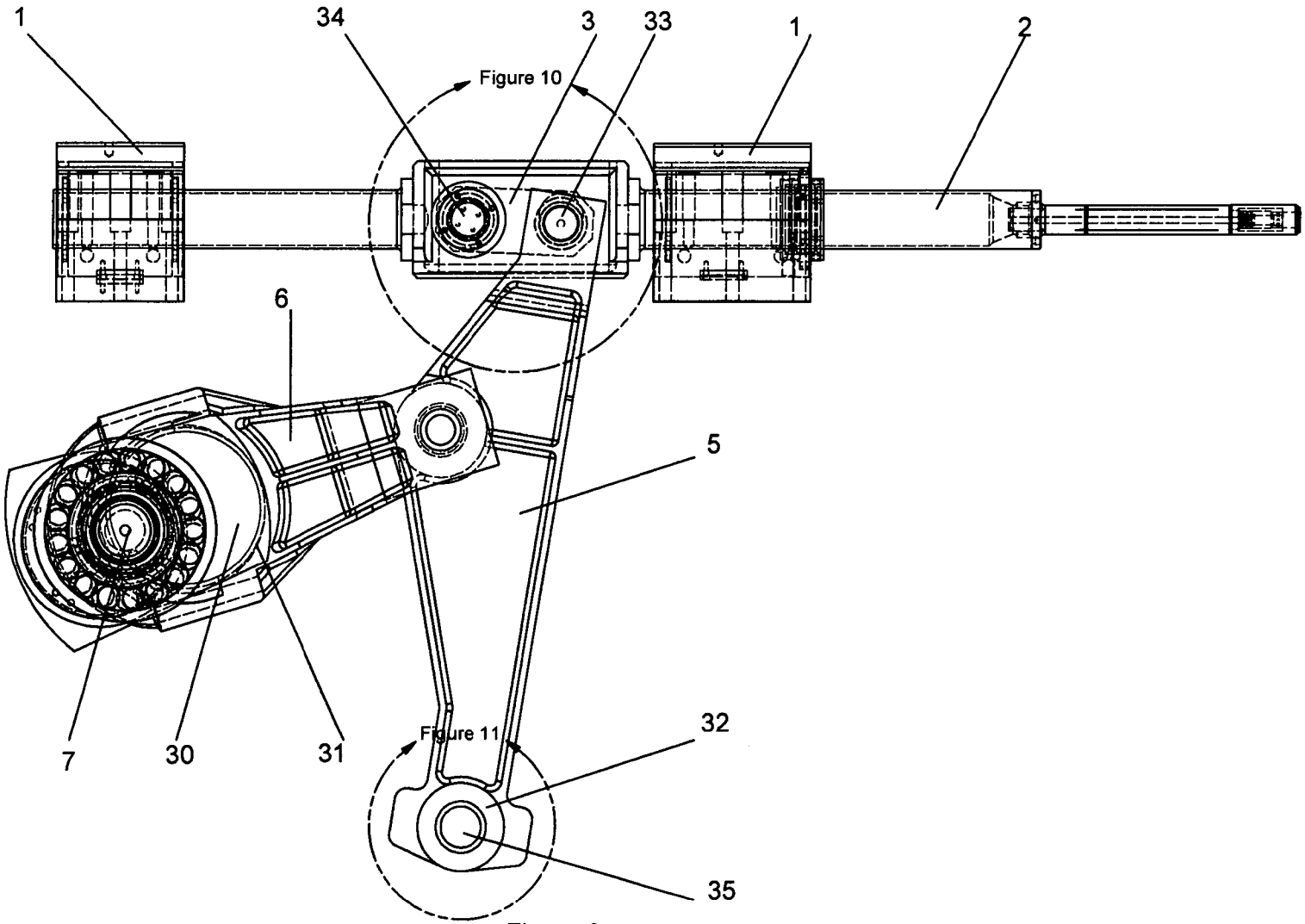
Figure 9 Prior Art
FIG. 9 is longitudinal cross section of FIG. 1 through ram centerline of the internal components with the press at front dead center.
Figure 10:
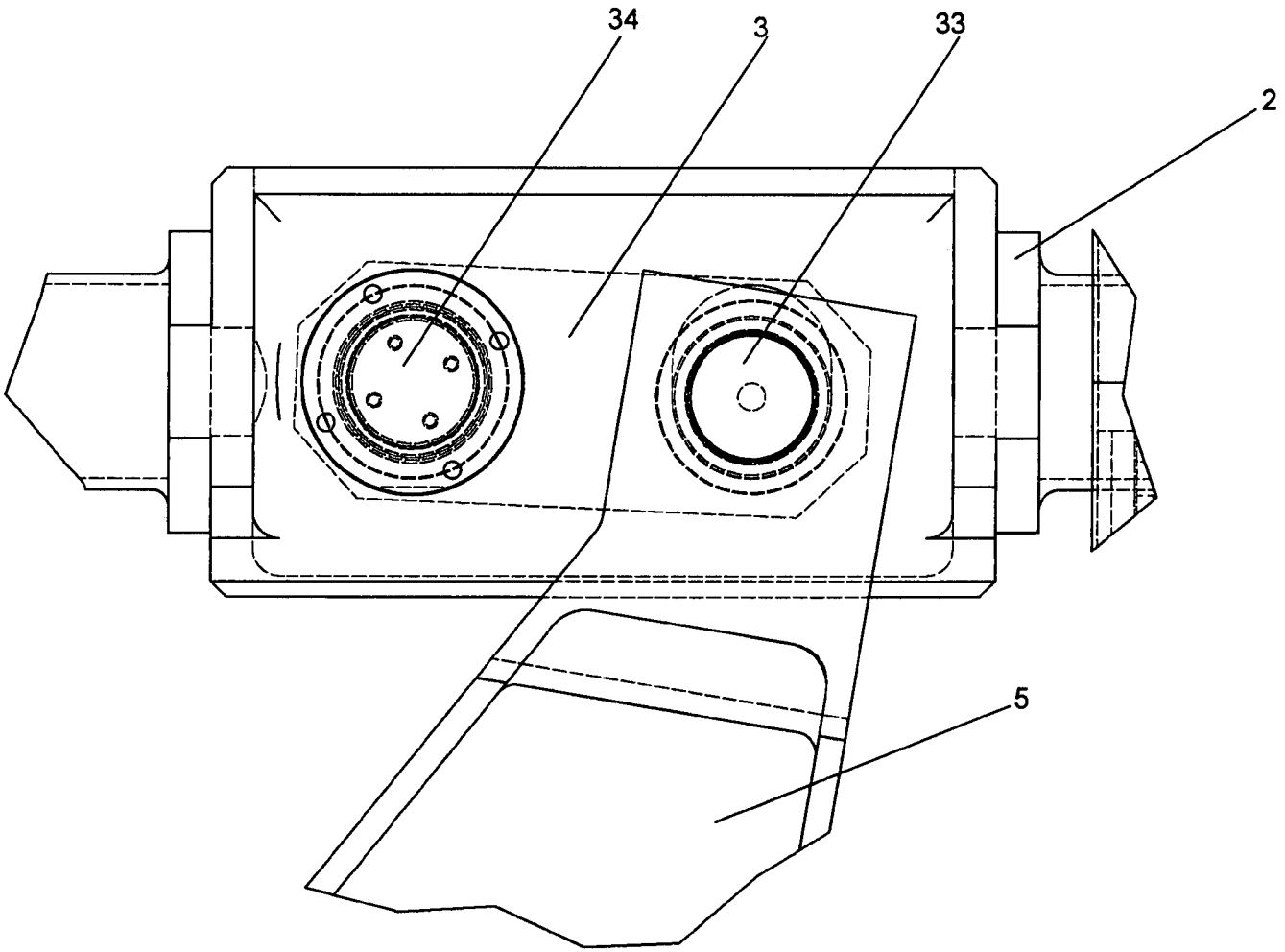
Figure 10 Prior Art
FIG. 10 is a large-scale detail view of FIG. 9 showing the ram driving connection point at-front dead center.
Figure 11:
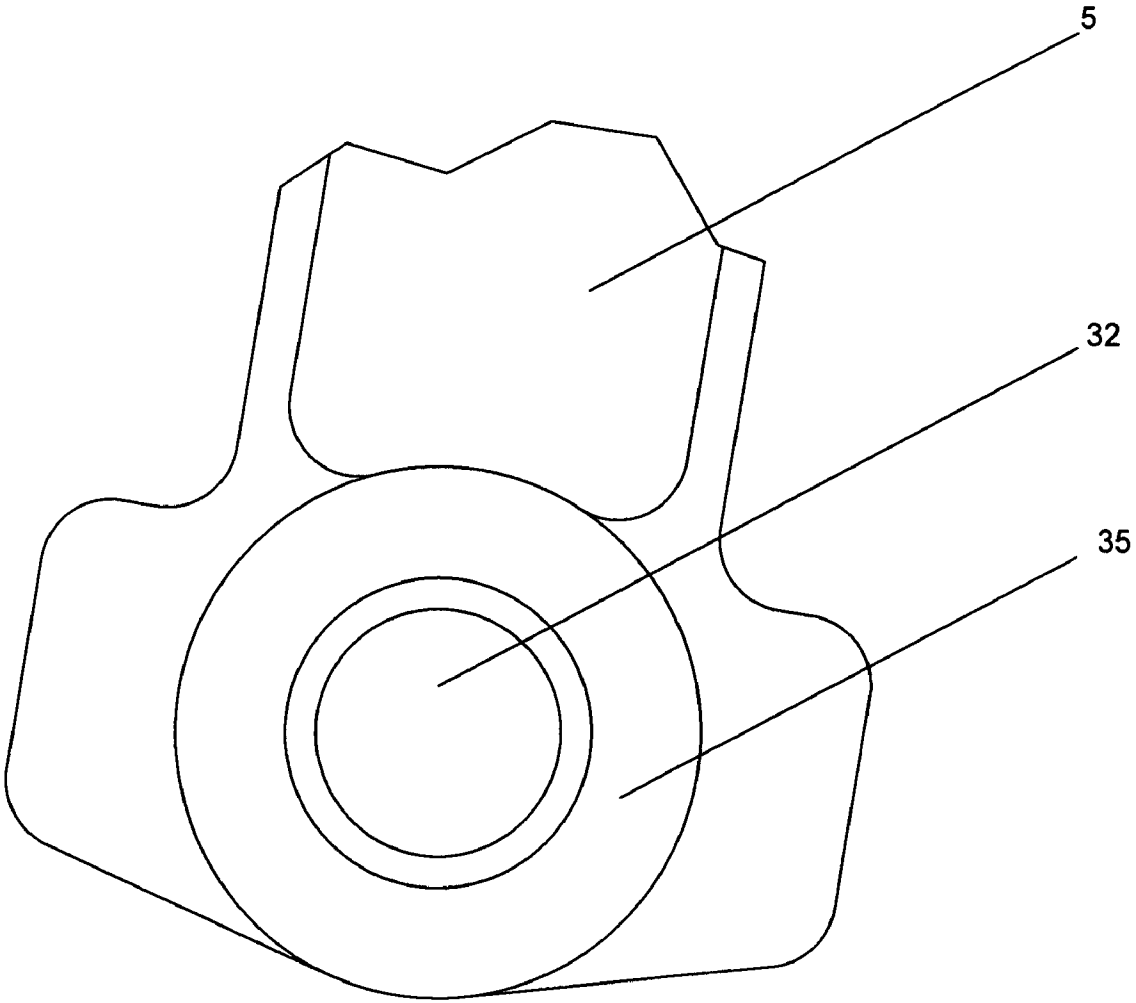
Figure 11 Prior Art
FIG. 11 is a large-scale detail view of FIG. 9 showing the beam pivot connection at front dead center.
Figure 12:
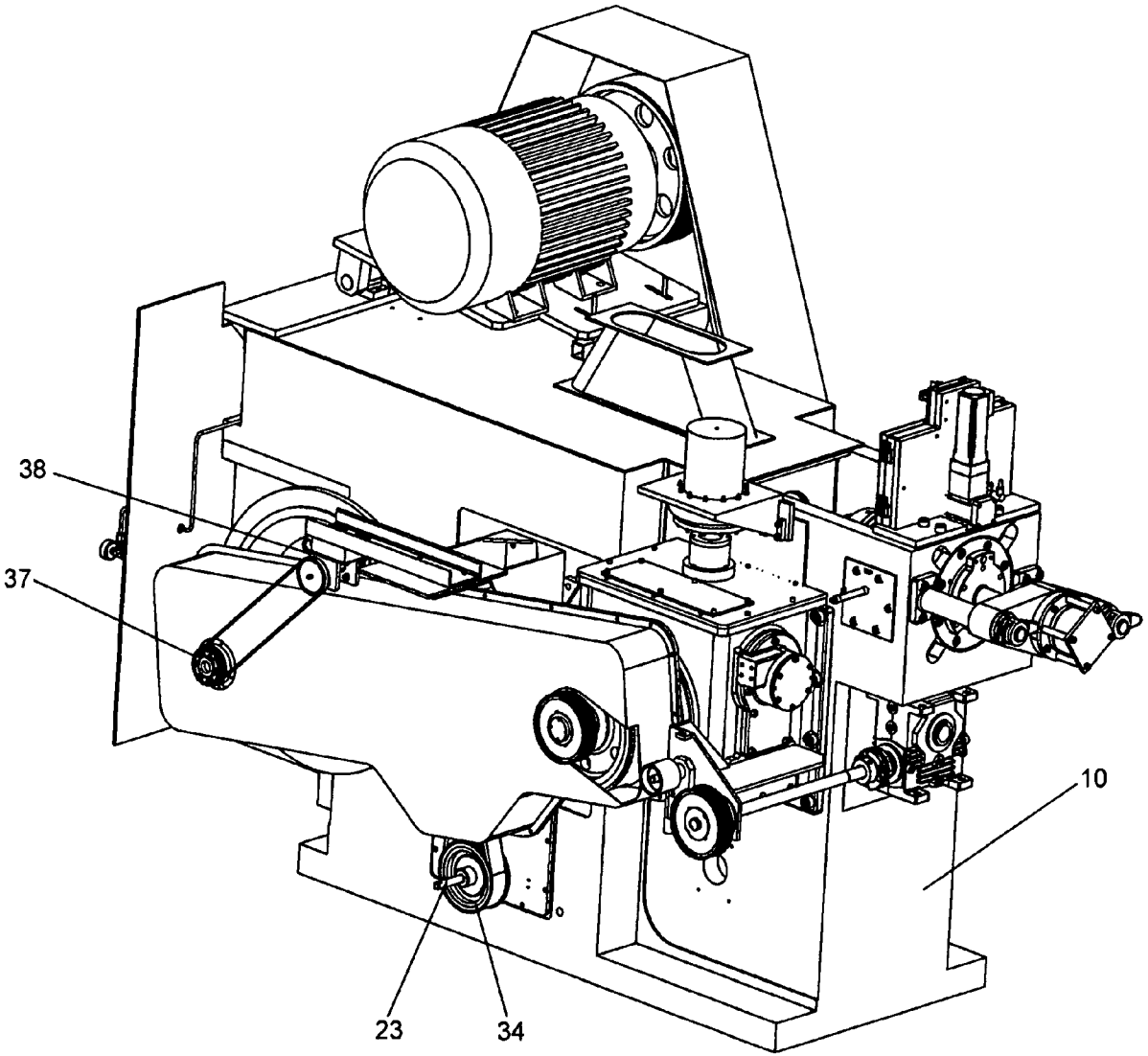
FIG. 12 is an isometric view of a metal forming press according to the invention.

FIG. 12 is an isometric view of a metal forming press according to the invention. A belt or chain drive from crankshaft 7 to eccentric shaft 23 and sprocket 34 are shown.

Figure 13:
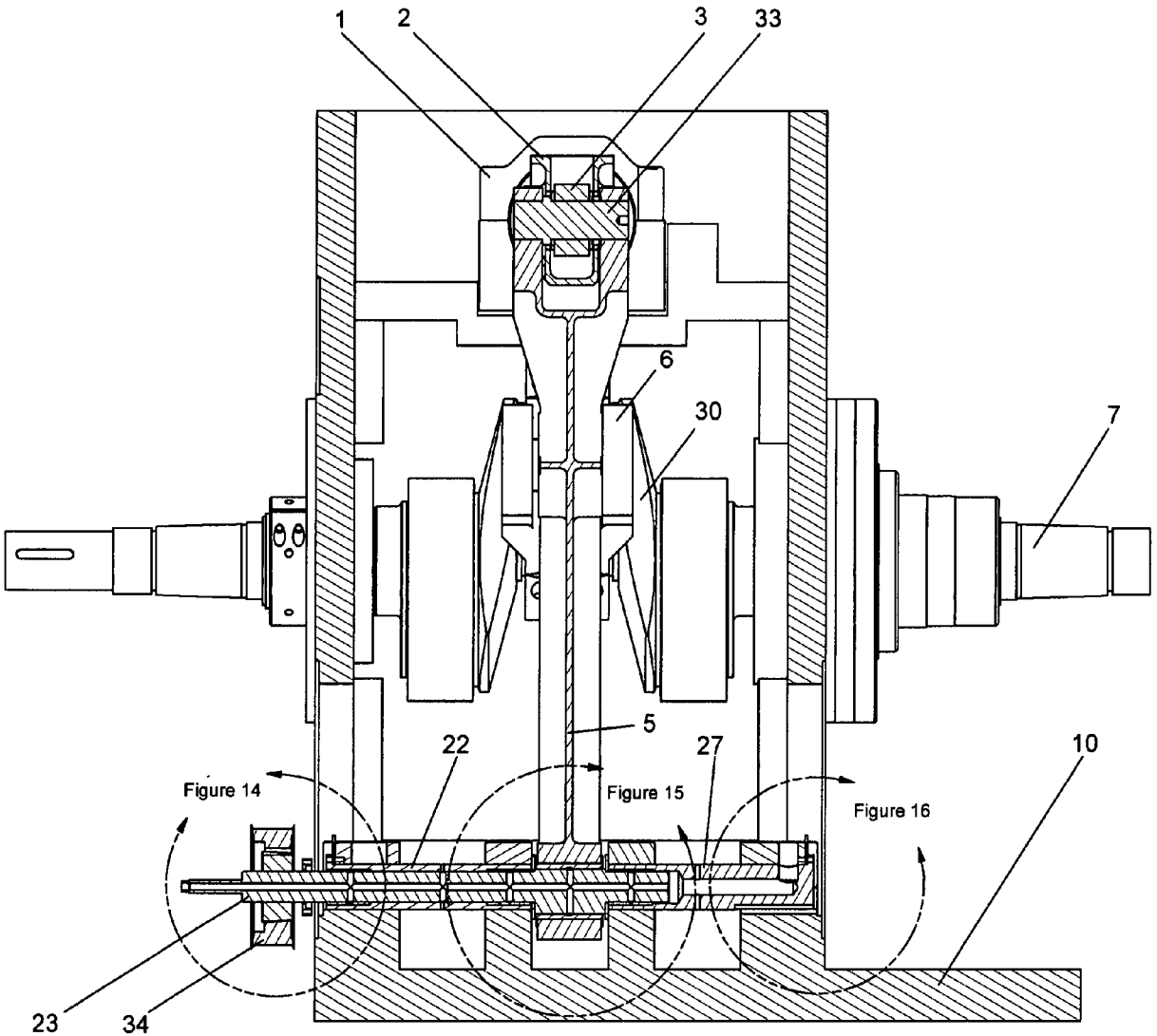
FIG. 13 is a cross section of the invention through the beam pivot.
Figure 14:
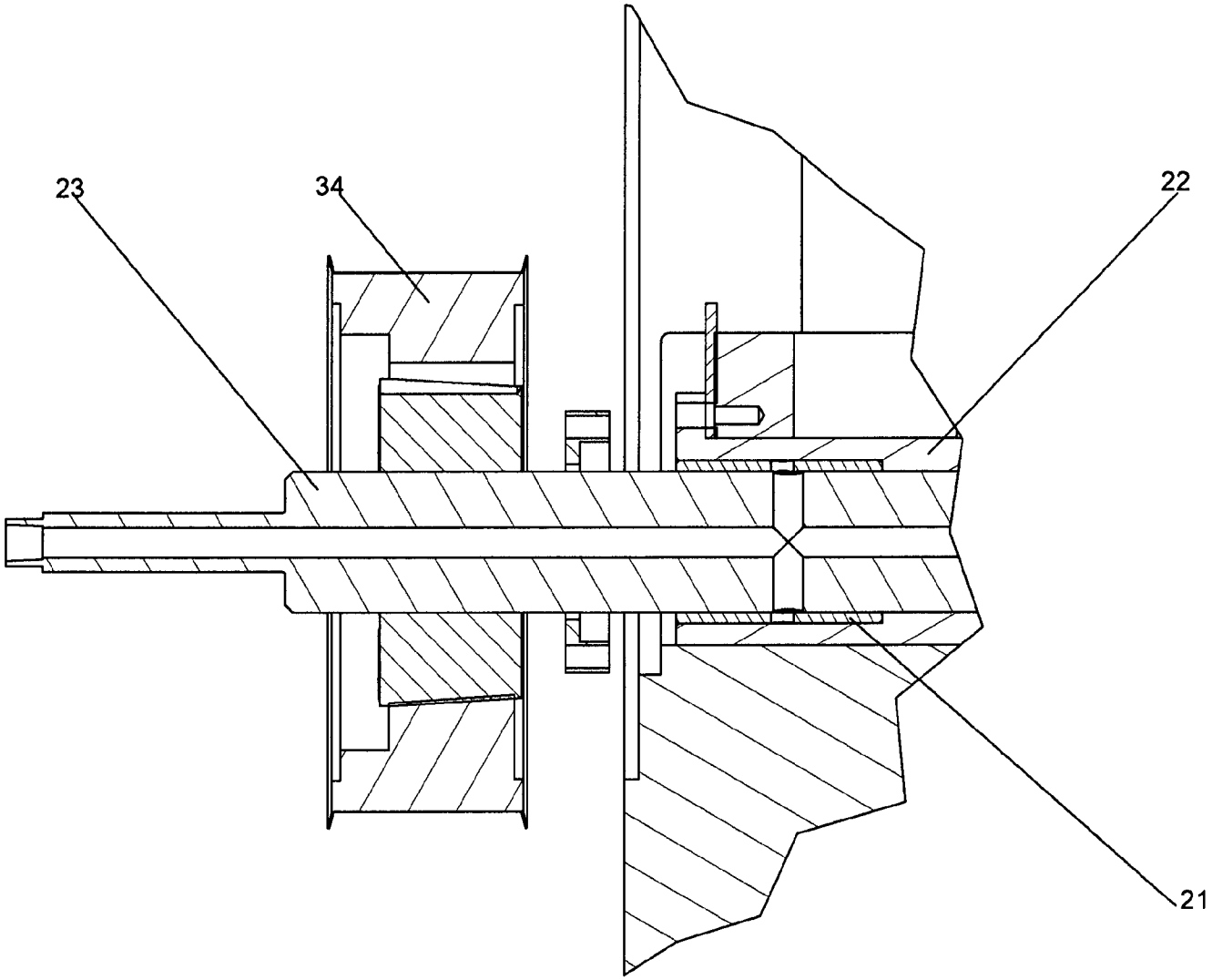
FIG. 14 is a large-scale detail view of FIG. 12 showing the left support.
Figure 15:
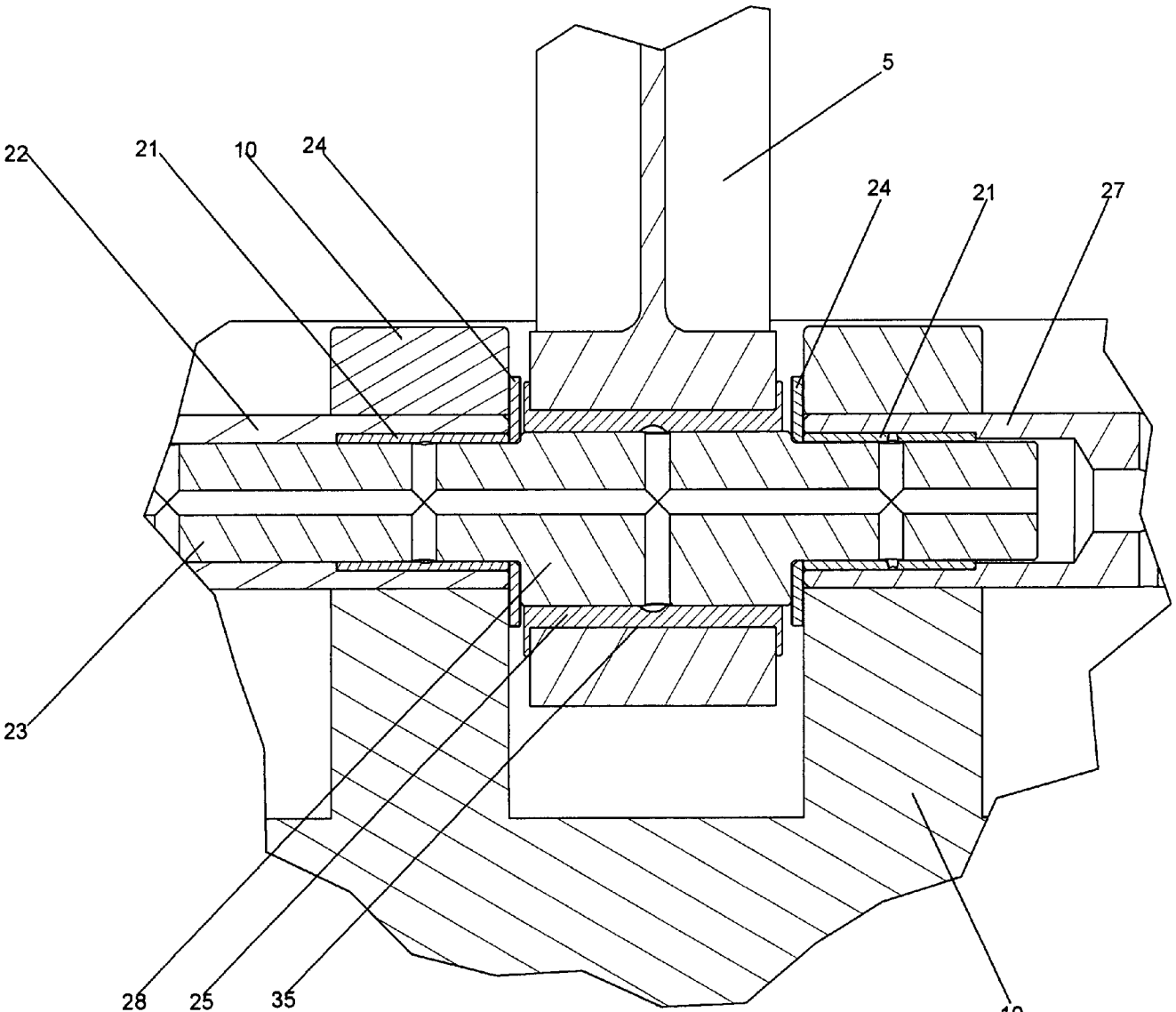
FIG. 15 is a large-scale detail view of FIG. 12 showing the beam pivot.
Figure 16:
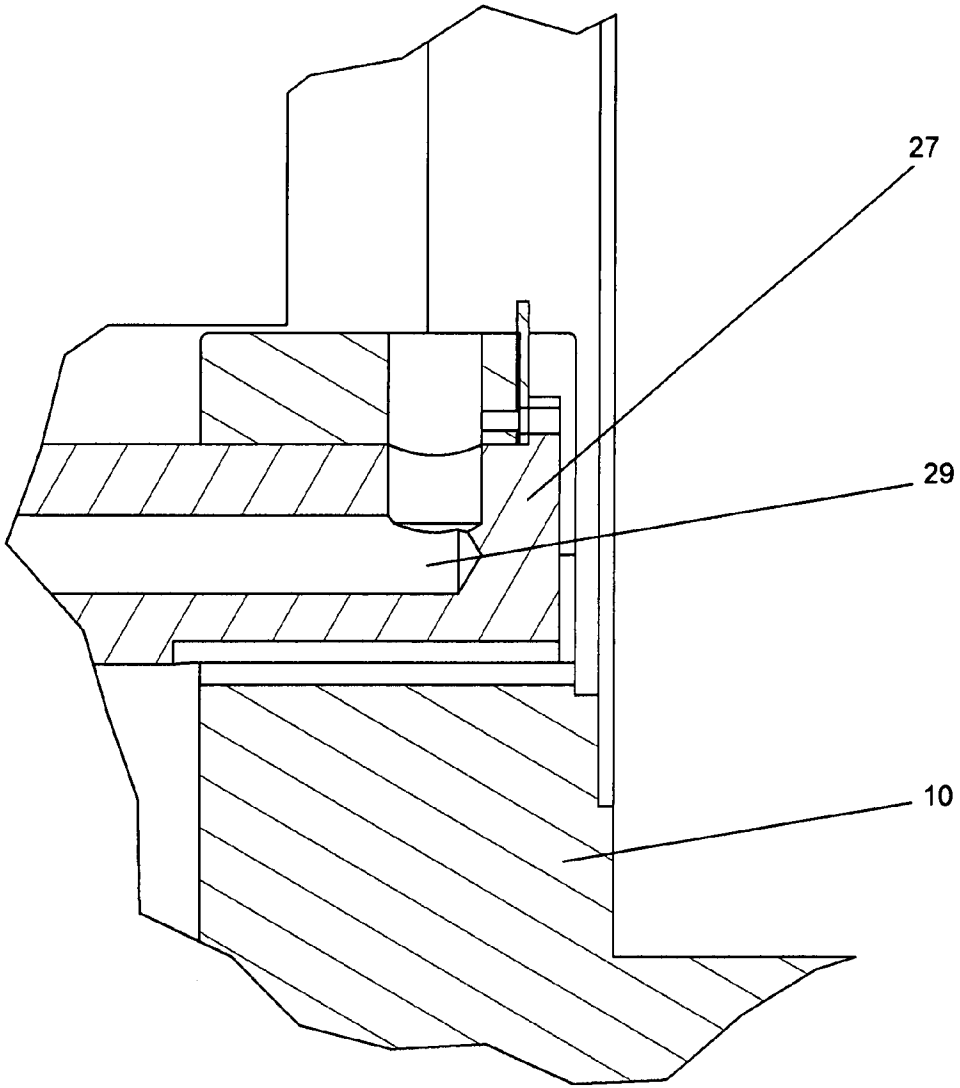
FIG. 16 is a large-scale detail view of FIG. 12 showing the right support.

FIG. 13 is a section through pivot point 32 of a mechanism to correct for straight line drive of the ram. FIGS. 14, 15, and 16 are detailed views of specific areas of FIG. 13. Lower pivot 35 is movable and has the necessary components to control its movement.

Left support shaft 22 and right support shaft 27 are fixed in machine frame 10. Left support shaft 22 and right support shaft 27 are hollow and contain at least one bearing 21. The right support shaft 22 has two bearings 21 so as to fully support eccentric shaft 23.

In between left support shaft 22 and right support shaft 27 and eccentric lobe 28 of eccentric shaft 23 are a pair of thrust washers 24. Each thrust washer 24 retains eccentric shaft 23 axially in support shaft 22 and support shaft 27. Bearing 25 acts as the bearing surface between lower pivot 35 of beam 5 and eccentric lobe 28. Oil is supplied to bearing 21, thrust washer 24, and bearing 25 through oil passage 29.

Figures 17, 18, 19:
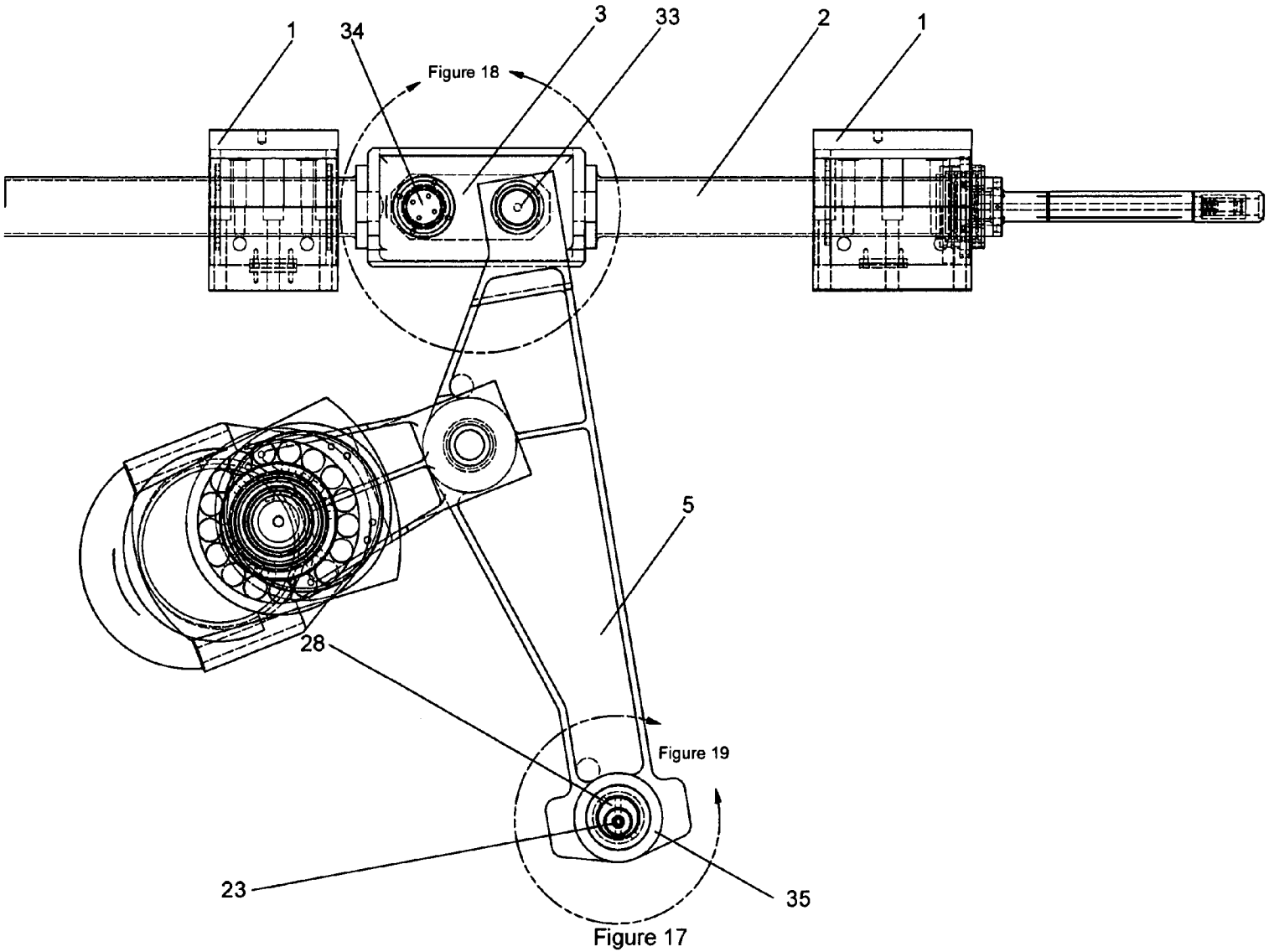
FIG. 17 is longitudinal cross section of FIG. 12 through ram centerline of the internal components with the press at back dead center.
FIG. 18 is a large-scale detail view of FIG. 16 showing the ram driving connection point at back dead center
FIG. 19 is a large-scale detail view of FIG. 16 showing the beam pivot connection at back dead center.
Figure 18:
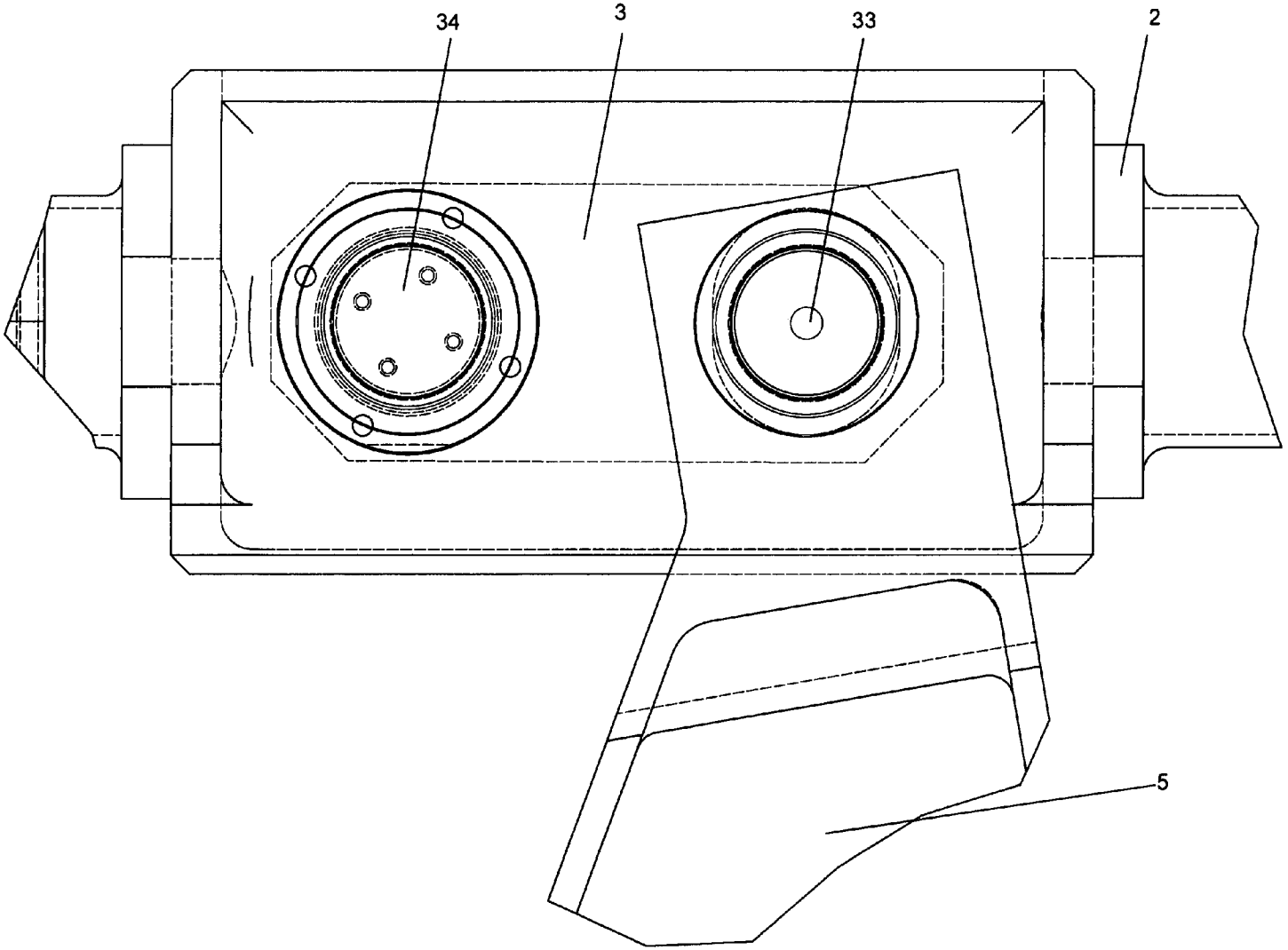
Figure 19:
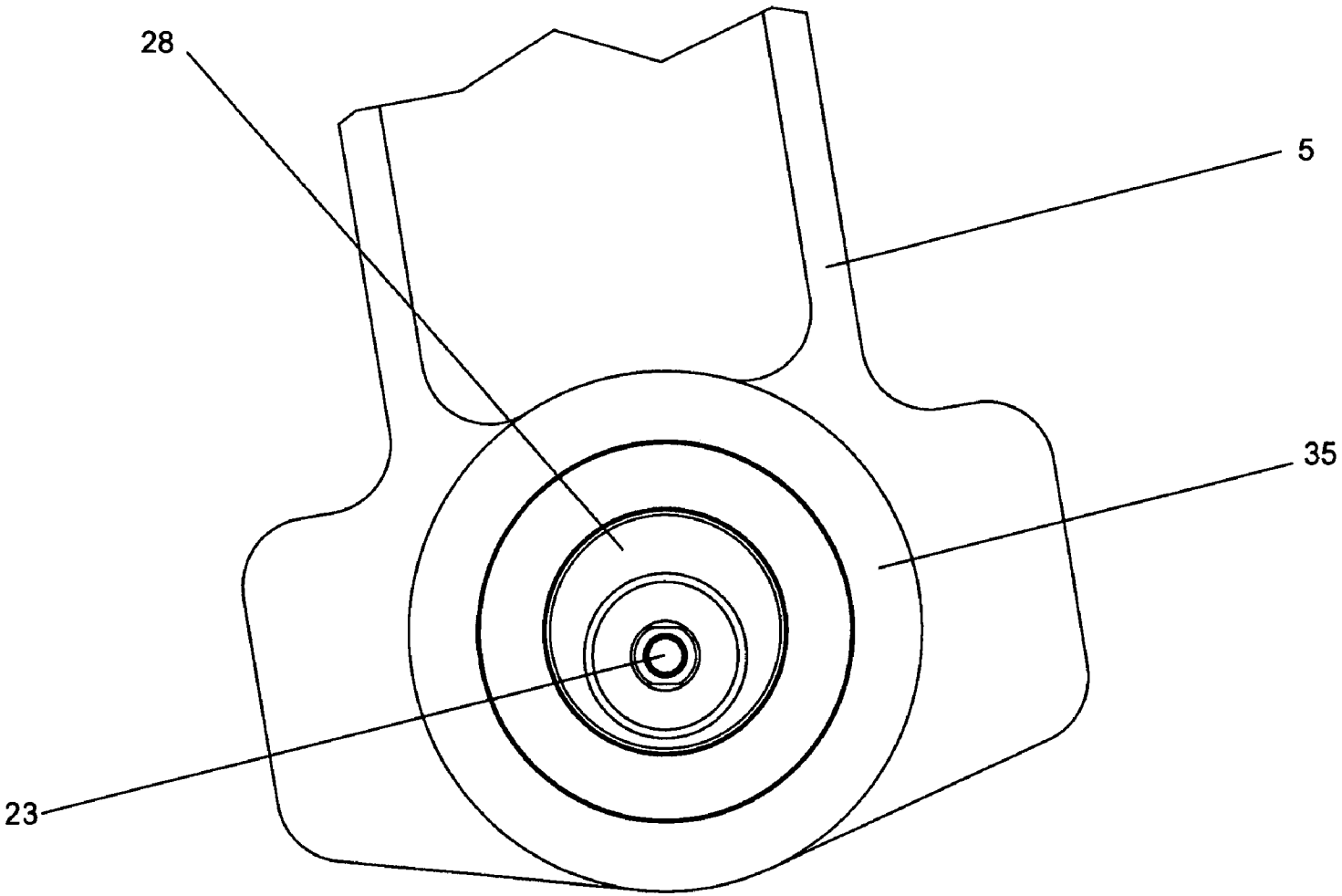

In operation, eccentric shaft 23 is driven via a belt or chain drive from crankshaft 7 through sprocket 34 at double the rotational speed of crankshaft 7. As eccentric shaft 23 rotates, lower pivot point 35 of beam 5 is moved in a circle around left support shaft 22 and right support shaft 27. The motion of eccentric shaft 23 is timed to the rotation of crankshaft 7 so that eccentric lobe 28 is at its approximate highest point when ram 2 is at its back dead center position. Eccentric lobe 28 has therefore raised lower pivot point 35 of beam 5 so that upper pivot point 32 is in a straight line path with the common axis of front and rear sliding bearings 1 and ram 2. FIGS. 17, 18, and 19 show component positions at back dead center.

Figure 20:
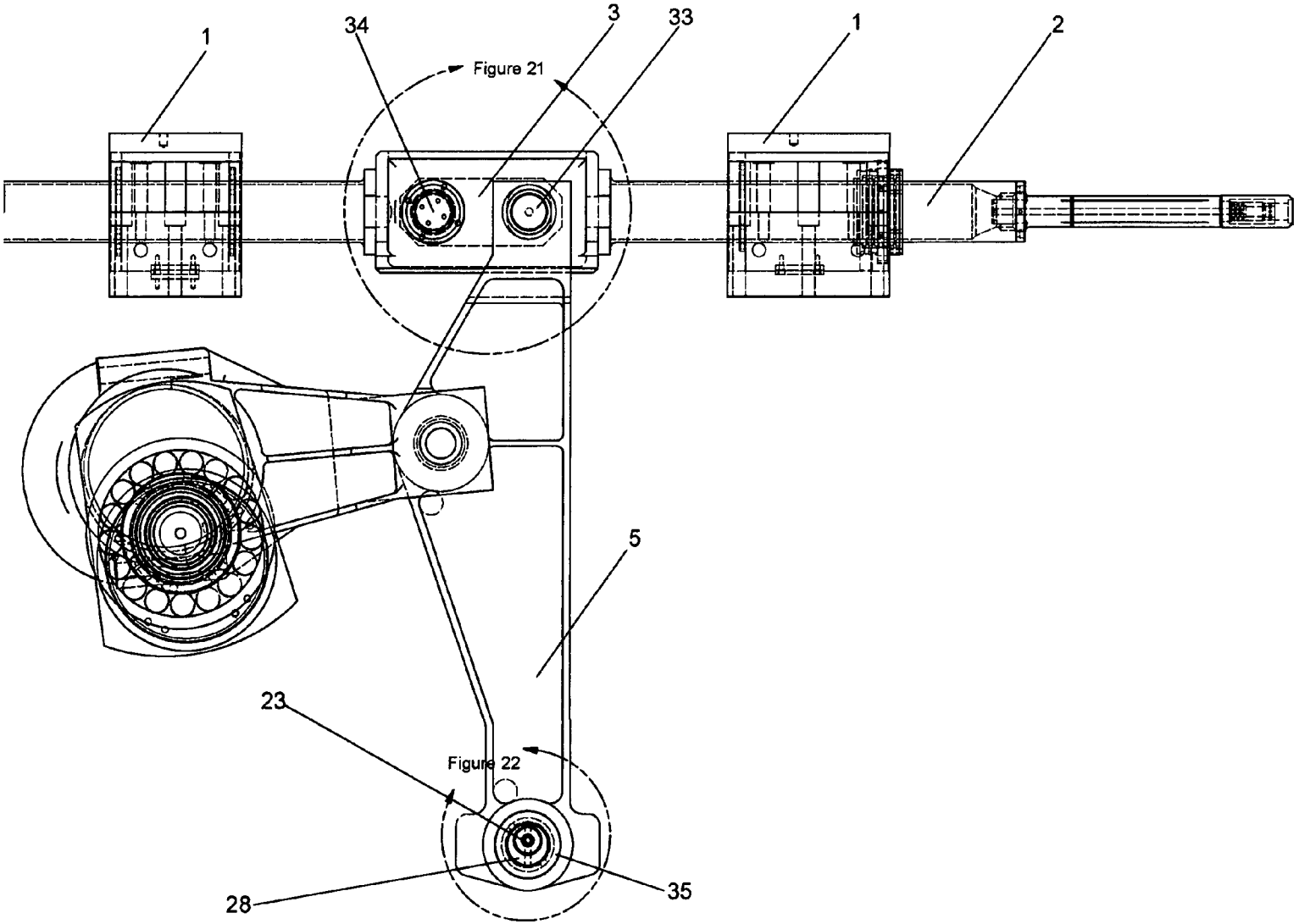
FIG. 20 is longitudinal cross section of FIG. 12 through ram centerline of the internal components with the press at mid-stroke.
Figure 21:
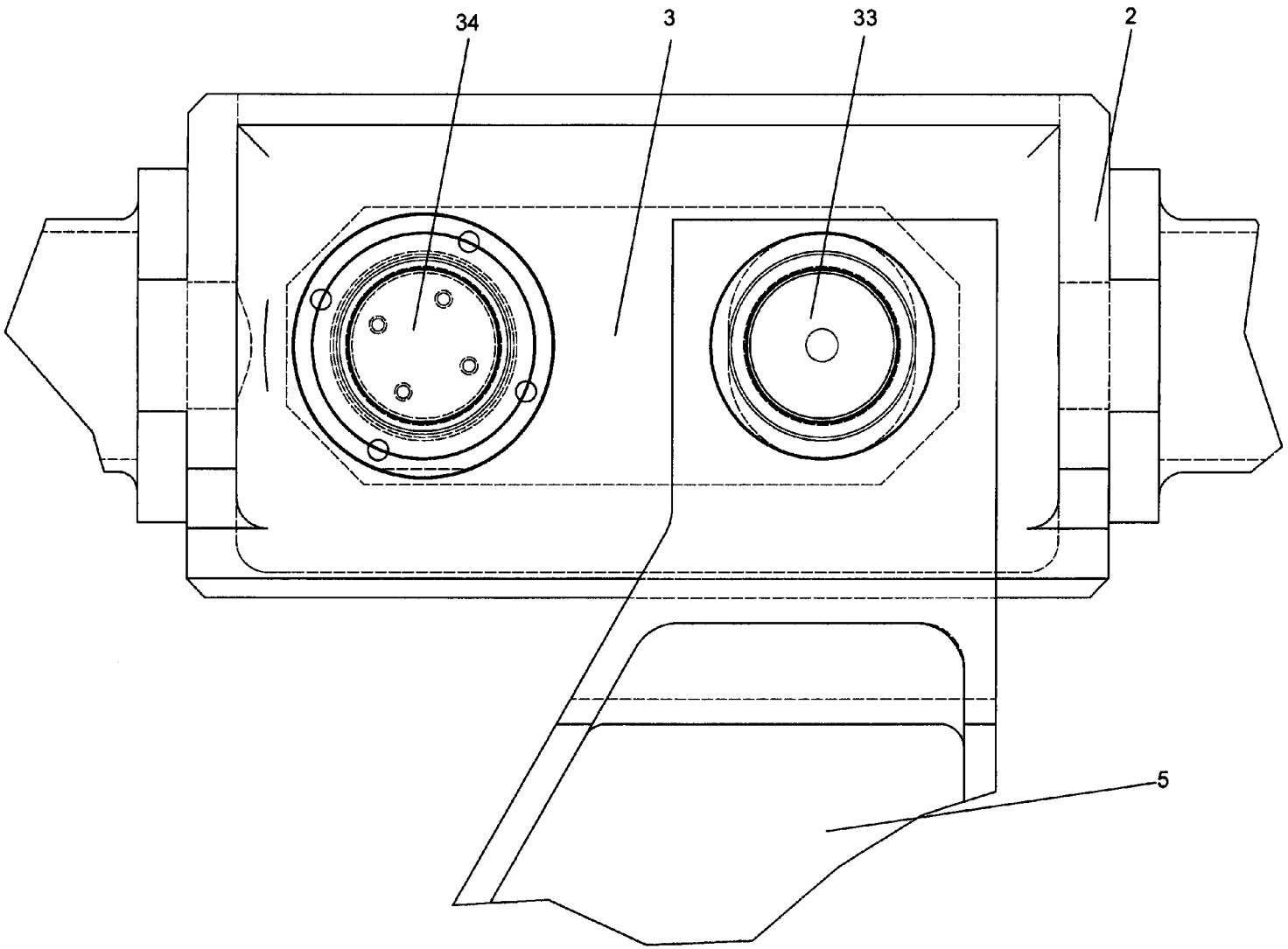
FIG. 21 is a large-scale detail view of FIG. 19 showing the ram driving connection point at mid-stroke.
Figure 22:
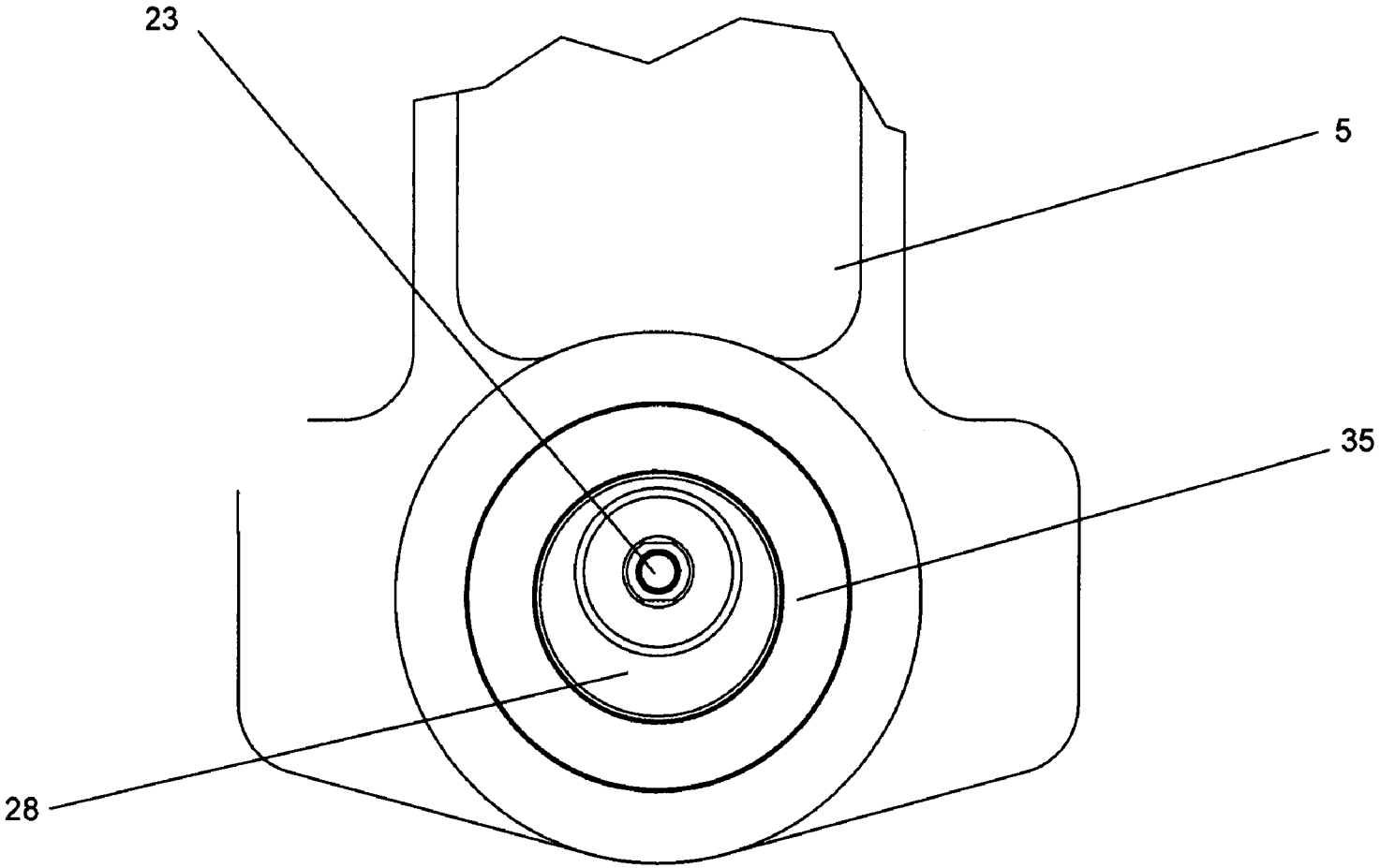
FIG. 22 is a large-scale detail view of FIG. 19 showing the beam pivot connection at mid-stroke.

As crankshaft 7 rotates to mid-stroke (approximately 90 degrees), eccentric shaft 23 rotates approximately 180 degrees. At mid-stroke eccentric lobe 28 is in its lowest position. Eccentric lobe 28 pulls lower pivot point 35 of beam 5 down so that upper pivot point 33 is again placed in a straight line path with the front and rear sliding bearings 1 and ram 2. FIGS. 20, 21, and 22 show component positions at mid-stroke.

Figure 23:
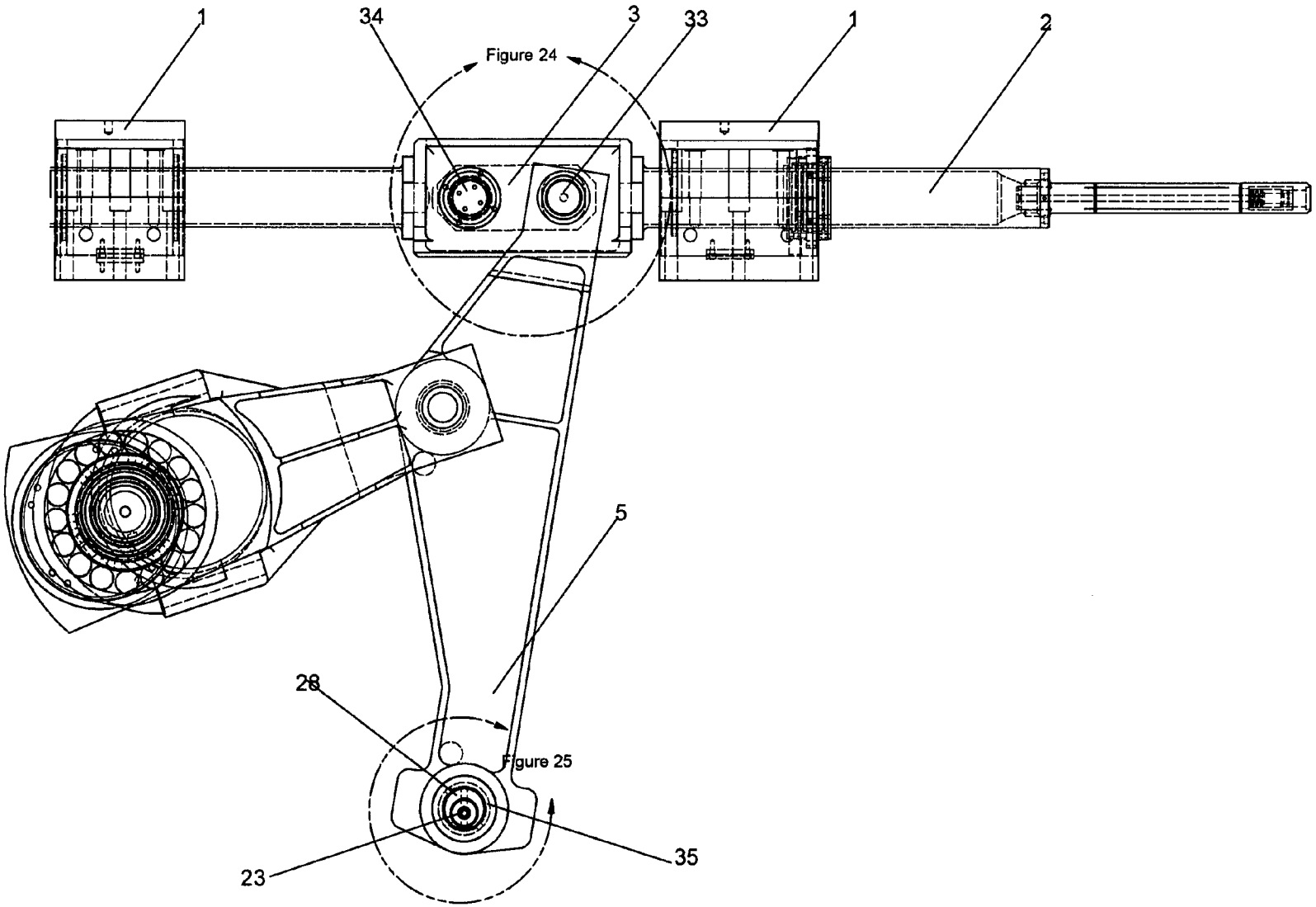
FIG. 23 is longitudinal cross section of FIG. 12 through ram centerline of the internal components with the press at front dead center.
Figure 24:
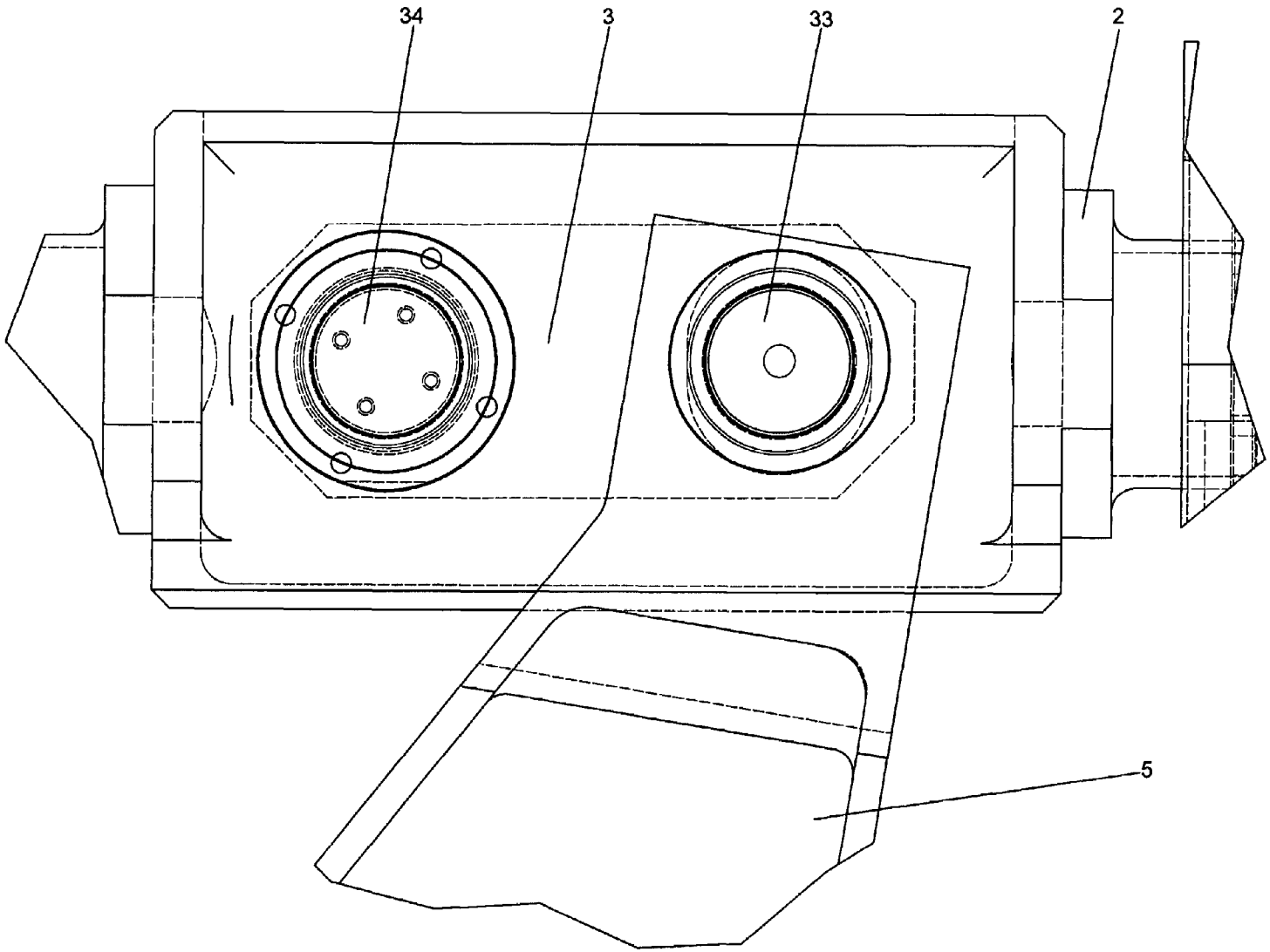
FIG. 24 is a large-scale detail view of FIG. 22 showing the ram driving connection point at front dead center.
Figure 25:
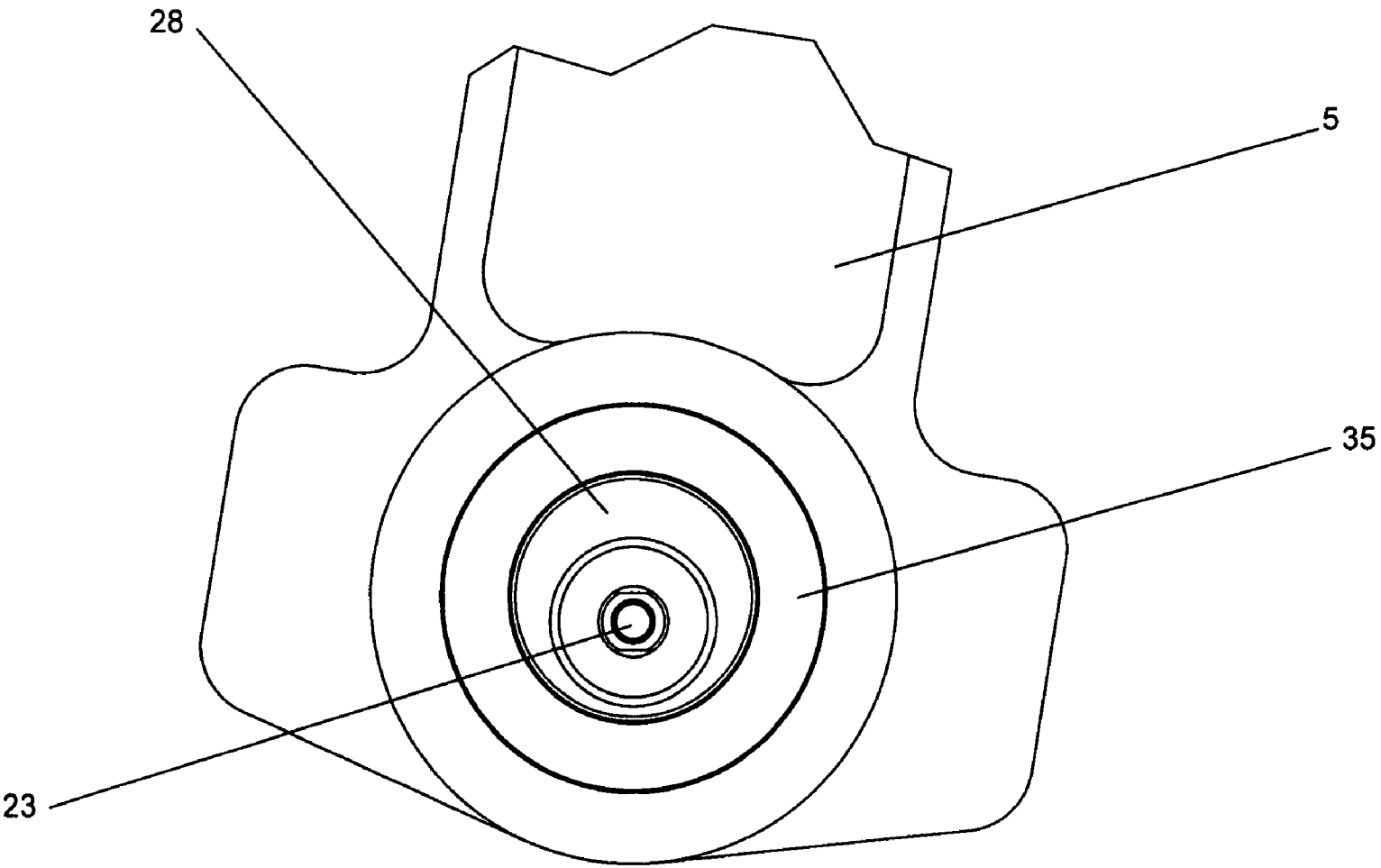
FIG. 25 is a large-scale detail view of FIG. 22 showing the beam pivot connection at front dead center.

As crankshaft 7 continues to rotate to front dead center (approximately another 90 degrees), eccentric shaft 23 rotates approximately 180 degrees again. At front dead center, eccentric lobe 28 is again in its highest position. Eccentric lobe 28 pushes lower pivot point 35 of beam 5 up so that upper pivot point 33 is again placed in a straight-line path with the front and rear sliding bearings 1 and ram 2. FIGS. 23, 24, and 25 show component locations at front dead center.

As crankshaft 7 rotates to mid-stroke on the return stroke, (approximately 90 degrees), eccentric shaft 23 rotates approximately another 180 degrees. Therefore, at mid-stroke, eccentric lobe 28 is in its lowest position. Eccentric lobe 28 pulls lower pivot point 35 of beam 5 down so that upper pivot point 33 is again placed in a straight line path with the front and rear sliding bearings 1 and ram 2. The mechanism returns to the positions shown in FIGS. 20, 21, and 22.

In the example shown in FIGS. 12–25, the angle of link 3 is controlled so that its angle to ram 2 never exceeds 0.2 degrees. This represents an improvement in link 3 angle by a factor of 12.

Figure 26:
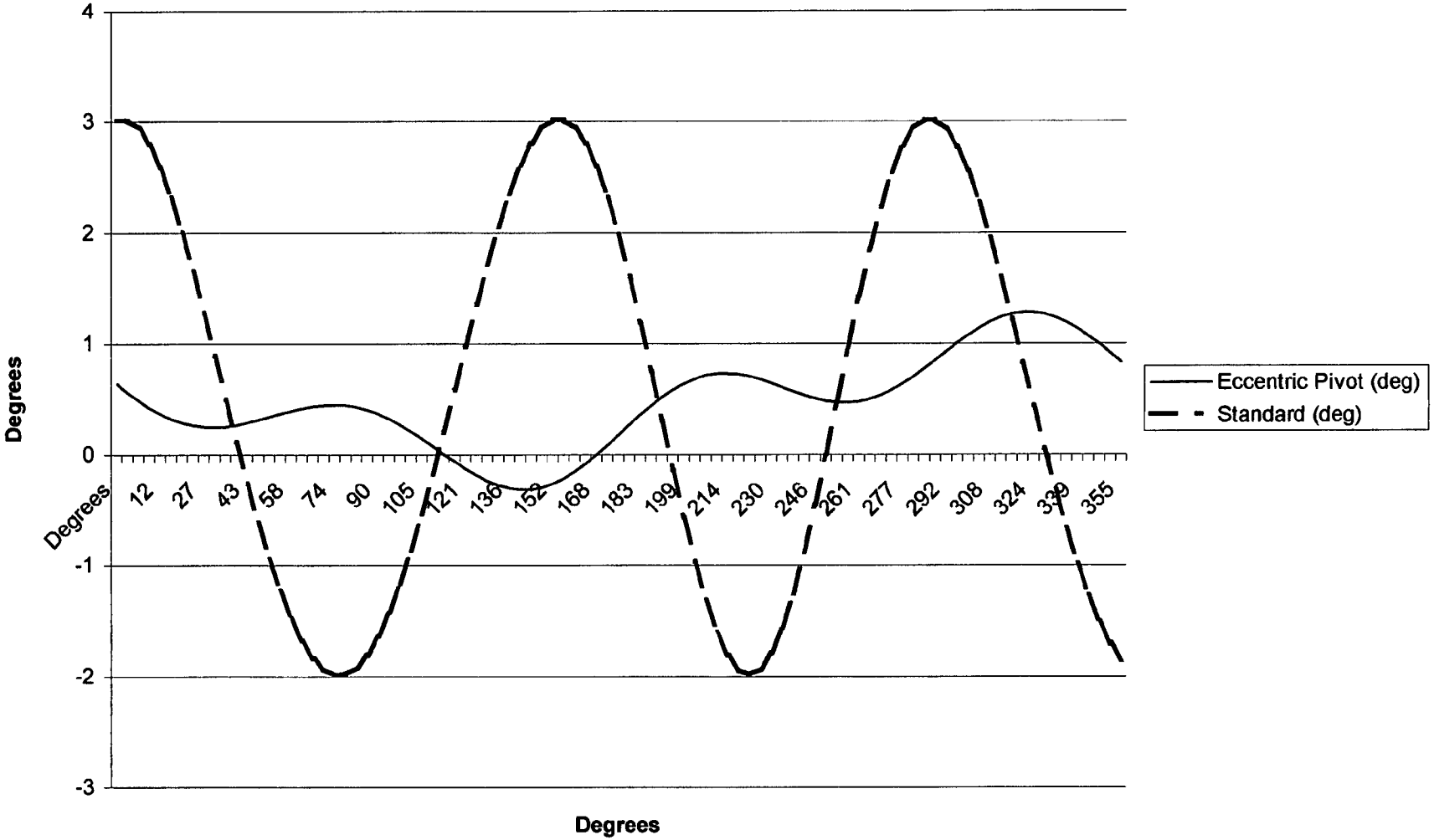
FIG. 26 is a graphical representation of the link angles versus stroke of a conventional press with those of a press according to the invention.

FIG. 26 is a graphical representation of the link 3 angles of both the traditional drive and the new drive. This is based on an actual operating beverage can metal forming press and as such, due to manufacturing tolerances, the values in the graphs are slightly different from the above discussion. FIG. 26 shows the reduction of link 3 angles throughout the machine stroke.

Figure 27:
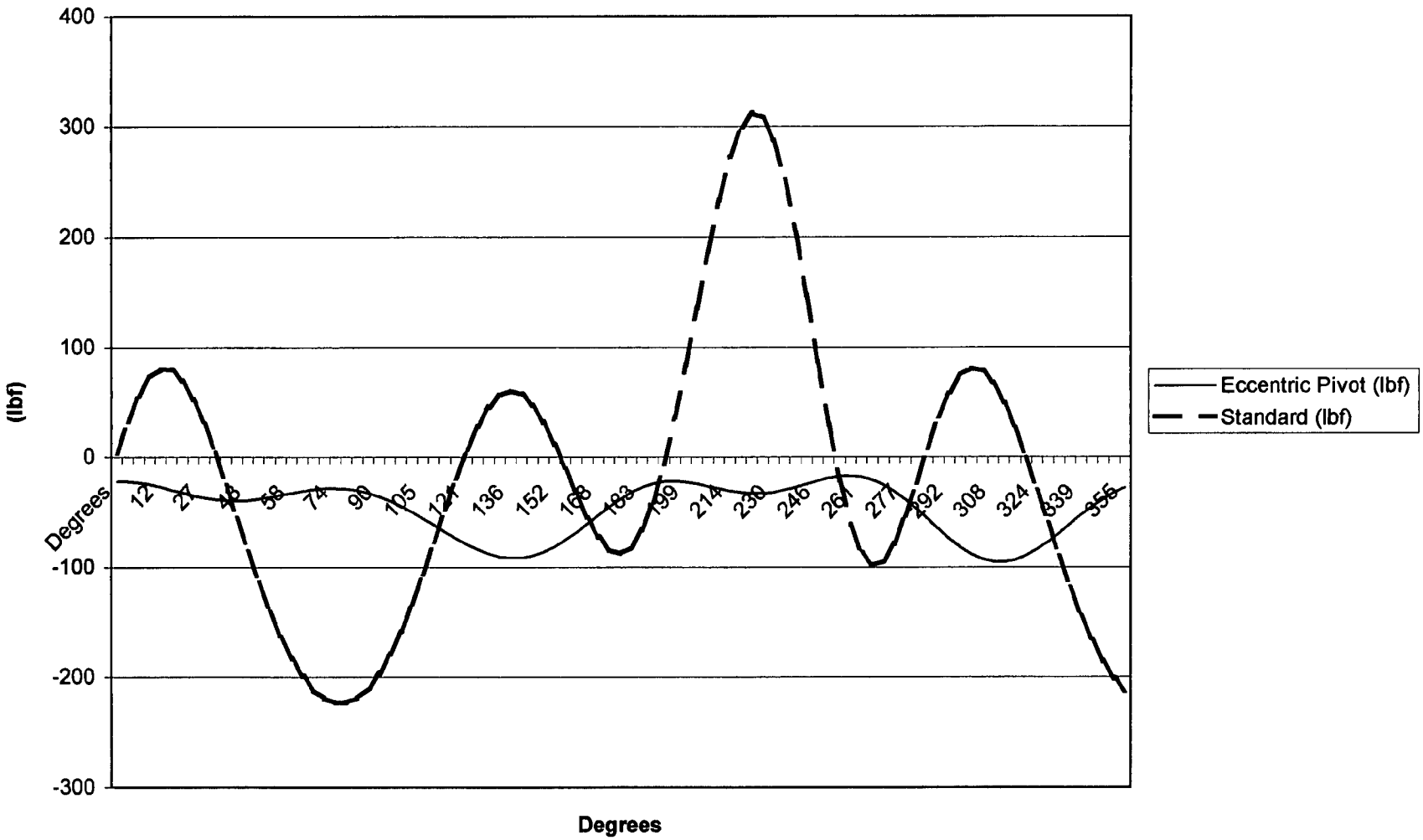
FIG. 27 is a graphical representation comparing the vertical forces on the ram of a conventional press with those of a press according to the invention.

FIG. 27 is a graphical representation of the vertical forces transmitted by link 3 to ram 2 of both the traditional drive and the new drive. This is based on an actual operating beverage can metal forming press and as such, due to manufacturing tolerances, the values in the graphs are slightly different from the above discussion. This graph shows that the normal forces are reduced from an absolute magnitude of 500 lbs to an absolute magnitude of 80 lbs.

The reduction in vertical forces greatly reduces deflection of the forming punch in the forming dies. The reduced deflection greatly improves the accuracy of the formed part and also greatly improves forming tool life.

The above discussion referred to crankshaft 7 indexing approximately 90 degrees to each of the various stroke positions. Machines utilizing this type of drive linkage are quick return mechanisms. Therefore they inherently have unequal degree durations for ram motion on the forward stroke and the return stroke. In the specific case cited above, the number of crankshaft 7 degrees to extend ram 2 from back dead center to front dead center is measurably different from the number of crankshaft 7 degrees required to retract ram 2 from front dead center to back dead center. Since the eccentric shaft 23 is rotated at a constant rate, i.e., 2 degrees for every degree of crankshaft 7 rotation, the front dead center and mid-stroke positions do not correspond exactly to the 180 degree rotation positions of eccentric shaft 23. That makes the solution as presented above an approximate, although very good, straight-line solution.

Figure 28:
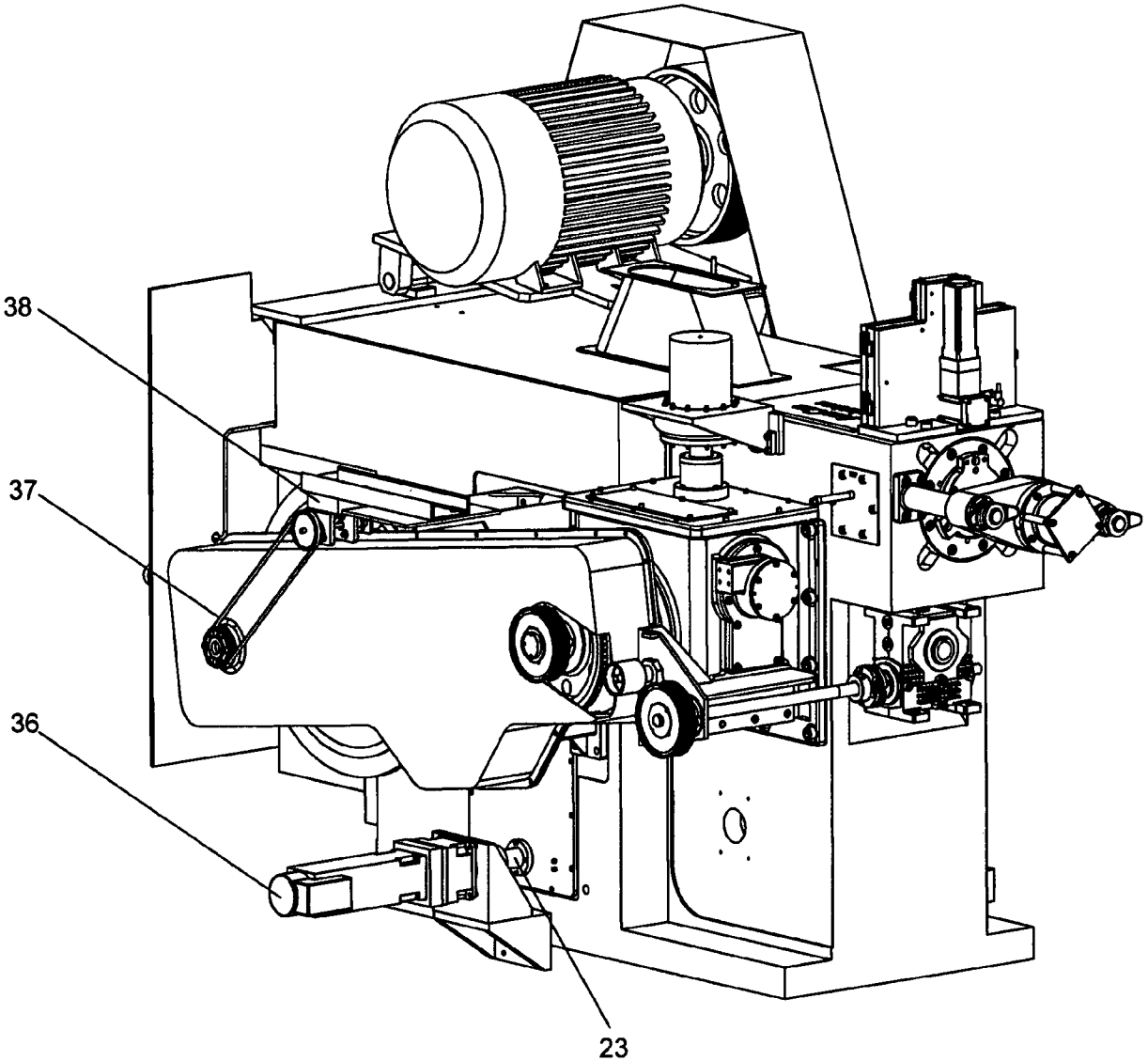
FIG. 28 is an isometric view of another embodiment of the invention

However, FIG. 28 discloses a method of driving eccentric shaft 23 via servo motor 36 rather than with a direct mechanical connection such as a belt. Using this method, one can control the rotational position of eccentric shaft 23 so that an exact straight line is produced by the mechanism. Crankshaft 7 uses belt drive 37 to rotate encoder 38. While crankshaft 7 continuously rotates, encoder 38 constantly reports crankshaft position to the servo control system. The servo control system operating program contains a stored table of values for eccentric shaft 23 position versus crankshaft 7 position required to generate an exact straight line. The servo control system then sends the appropriate signals to servo motor 36 to rotationally position eccentric shaft 23 so that upper pivot 33 always moves in a straight line.

Using this method, link 3 angles are maintained at zero. Therefore, all vertical forces induced by driving ram 2 through its motion are removed from ram 2, increasing formed part accuracy and increasing tool life.

Stroke Length Change

Operating eccentric shaft 23 in another fashion will change machine stroke.

By driving eccentric shaft 23 in a one-to-one relationship with the crankshaft 7 and timing the position of eccentric shaft 23 differently with respect to crankshaft 7, the angle of beam 5 at front dead center and back dead center can be either increased or decreased resulting in either a longer or shorter machine stroke.

For example, if, at back dead center, eccentric shaft 23 is positioned with eccentric lobe 30 horizontally to the front of the mechanism, the rearward angle of beam 5 is increased, thus moving ram 2 further back in the machine frame.

If, at front dead center, eccentric shaft 23 is positioned with eccentric lobe 30 horizontally to the rear of the mechanism, the forward angle of beam 5 is increased, thus moving ram 2 further forward in the machine frame.

This arrangement effectively increases machine stroke. However, by reversing the position of eccentric shaft 23 with respect to crankshaft 7, machine stroke can be shortened.

However, driving eccentric shaft 23 in such a manner, while providing easy stroke length changes, increases link 3 angles and thus provides poorer straight-line drive.

It will be understood that, while presently preferred embodiments of the invention have been illustrated and described, the invention is not limited thereto, but may be otherwise variously embodied within the scope of the following claims.

I claim:

1. A metal forming press having a straight line drive mechanism and comprising:

(a) a machine frame;

(b) a rotating crankshaft mounted in the frame and having an eccentric throw;

(c) a connecting rod pivotally attached to the eccentric throw;

(d) a fixed bore in the frame for pivotally receiving one end of a beam;

(e) an eccentric shaft in the fixed bore, which eccentric shaft has an eccentric lobe;

(f) an oscillating beam having a plurality of parallel bores, including a bore at its approximate center and a bore at each of its ends, with one end bore being pivotally connected to the eccentric lobe of the eccentric shaft, and the central bore being pivotally connected to the connecting rod; and (g) a link pivotally connected at one end to the other end bore of the beam, with the other end of the link being pivotally connected to a fixed bore on a ram sliding on a set of linear bearings so as to move in a straight line.

2. A press according to claim 1 wherein the eccentricity of the eccentric shaft is approximately equal to the arc error of the beam.

3. A press according to claim 1 wherein the eccentric shaft is mechanically driven and synchronized with the crankshaft.

4. A press according to claim 3 wherein the eccentric shaft rotates, relative to the rotation of the crankshaft, an amount necessary to ensure that the bore of the beam pivotally connected to the link is placed in essentially a straight line with the path of the ram or slide.

5. A press according to claim 4 wherein the eccentric shaft rotates twice for each crankshaft revolution.

6. A press according to claim 4 wherein the eccentric throw is essentially horizontal when the ram is at either front dead center or back dead center.

7. A press according to claim 1 which further comprises (a) a servo drive connected to and rotating the eccentric shaft;

(b) an encoder that provides the angular position of the crankshaft;

(c) an encoder that provides the angular position of the eccentric shaft; and (d) a control system for driving the servo drive in an angular position relationship to the crankshaft so that the eccentric shaft rotates, relative to the rotation of the crankshaft, an amount necessary to ensure that the bore of the beam pivotally connected to the link is placed in essentially a straight line with the path of the ram.

8. A press according to claim 7 wherein the eccentric shaft rotates in continuous rotation.

9. A press according to claim 7 wherein the eccentric shaft oscillates.

* * * * *